US006490895B1

(12) United States Patent
Weinerman et al.

(10) Patent No.: US 6,490,895 B1
(45) Date of Patent: Dec. 10, 2002

(54) VERSATILE PADDLE HANDLE OPERATING MECHANISM FOR LATCHES AND LOCKS

(75) Inventors: Lee S. Weinerman, Medina, OH (US); Scott A. Arthurs, Brunswick, OH (US)

(73) Assignee: The Eastern Company, Cleveland, OH (US)

( * ) Notice: Subject to any disclaimer, the term of this patent is extended or adjusted under 35 U.S.C. 154(b) by 0 days.

(21) Appl. No.: 09/596,951

(22) Filed: Jun. 16, 2000

Related U.S. Application Data

(63) Continuation-in-part of application No. 09/481,145, filed on Jan. 12, 2000, and a continuation-in-part of application No. 09/481,146, filed on Jan. 12, 2000.

(60) Provisional application No. 60/139,699, filed on Jun. 17, 1999, and provisional application No. 60/115,797, filed on Jan. 12, 1999.

(51) Int. Cl.[7] ..... E05B 13/10

(52) U.S. Cl. ..... 70/208; 292/DIG. 31; 292/35; 292/166

(58) Field of Search ..... 70/208; 292/34, 292/DIG. 31, 36, 35, 166, 3, 167, 168

(56) References Cited

U.S. PATENT DOCUMENTS

| | | | | | |
|---|---|---|---|---|---|
| 2,349,192 | A | * | 5/1944 | Oxhandlder | 70/208 |
| 2,375,196 | A | * | 5/1945 | Cederwall | 70/118 |
| 2,486,586 | A | * | 11/1949 | Brittain et al. | 292/1 |
| 4,312,202 | A | | 1/1982 | Pastua, Jr. et al. | 70/472 |
| 4,312,203 | A | | 1/1982 | Davis | 70/472 |
| 4,312,204 | A | | 1/1982 | Davis | 70/472 |
| 4,312,205 | A | | 1/1982 | Reed et al. | 70/472 |
| 4,320,642 | A | | 3/1982 | Pastua, Jr. | 70/472 |
| 4,321,812 | A | | 3/1982 | Pelcin | 70/472 |
| 4,335,595 | A | | 6/1982 | Swan et al. | 70/149 |
| 4,470,277 | A | * | 9/1984 | Uyeda | 70/118 |
| 4,510,779 | A | * | 4/1985 | Ahad | 70/208 |
| 4,892,338 | A | * | 1/1990 | Weinerman et al. | 292/35 |
| 4,896,906 | A | | 1/1990 | Weinerman et al. | 292/48 |
| 4,911,487 | A | | 3/1990 | Rachocki | 292/216 |
| 4,917,412 | A | | 4/1990 | Swan et al. | 292/48 |
| 4,951,486 | A | * | 8/1990 | Braun et al. | 70/208 |
| 5,069,491 | A | | 12/1991 | Weinerman et al. | 292/48 |
| 5,117,665 | A | | 6/1992 | Swan et al. | 70/264 |
| 5,299,844 | A | | 4/1994 | Gleason | 292/240 |
| 5,439,260 | A | | 8/1995 | Weinerman et al. | 292/48 |
| 5,564,295 | A | | 10/1996 | Weinerman et al. | 70/208 |
| 5,586,458 | A | | 12/1996 | Weinerman et al. | 70/208 |
| 5,595,076 | A | | 1/1997 | Weinerman et al. | 70/208 |
| 5,611,224 | A | | 3/1997 | Weinerman et al. | 70/208 |
| 5,884,948 | A | | 3/1999 | Weinerman et al. | 292/216 |
| 5,941,104 | A | | 8/1999 | Sadler | 70/208 |
| 6,152,497 | A | * | 11/2000 | Vickers et al. | 292/34 |
| 6,209,366 | B1 | * | 4/2001 | Zagoroff | 70/208 |

* cited by examiner

*Primary Examiner*—Anthony Knight
*Assistant Examiner*—John B. Walsh
(74) *Attorney, Agent, or Firm*—David A. Burge

(57) ABSTRACT

A handle operating mechanism that may be lockable includes a housing that defines a forwardly facing recess for receiving a handle that is movable from a nested non-operated position to an extended operated position. A connection plate located behind the housing is pivotally supported by the housing for limited angular movement from a non-operated orientation to an operated orientation in response to movement of the handle from the non-operated position to the operated position. The connection plate is provided with a plurality of connection formations arrayed in a novel way about the pivot axis of the connection plate to ensure that pairs of lengthy, oppositely directed links coupled to the connection formations move concurrently and substantially equidistantly to operate various arrangements of remotely located latches including pairs of latches situated on opposite sides of the handle operating mechanism. A linkage that drivingly connects the handle to the connection plate may include a lock operated disconnect for preventing the handle from pivoting the connection plate when locked.

50 Claims, 20 Drawing Sheets

VERSATILE PADDLE HANDLE OPERATING MECHANISM FOR LATCHES AND LOCKS

REFERENCE TO PROVISIONAL APPLICATION

This application claims the benefit of U.S. Provisional Application Serial No. 60/139,699 filed Jun. 17, 1999 by Lee S. Weinerman et al entitled VERSATILE PADDLE HANDLE OPERATING MECHANISM FOR LATCHES AND LOCKS, the disclosure of which is incorporated herein by reference.

CROSS-REFERENCE TO RELATED APPLICATIONS

The present application also is a continuation-in-part of application Ser. No. 09/481,145 filed Jan. 12, 2000 by Lee S. Weinerman et al entitled LOCKABLE PADDLE HANDLE WITH DISCONNECT FEATURE FOR OPERATING REMOTELY LOCATED LATCHES (referred to hereinafter as the "First Disconnect Case"), and is a continuation-in-part of application Ser. No. 09/481,146 filed Jan. 12, 2000 by Lee S. Weinerman et al entitled LOCKABLE PADDLE HANDLE OPERATED ROTARY LATCH WITH DISCONNECT FEATURE (referred to hereinafter as the "Second Disconnect Case"), the disclosures of which are incorporated herein by reference.

The First and Second Disconnect Cases (identified in the paragraph just above) claim the benefit of the filing date of Provisional Application Ser. No. 60/115,797 filed Jan. 12, 1999, the disclosure of which also is incorporated herein by reference.

BACKGROUND OF THE INVENTION

1. Field of the Invention

The present invention relates to improvements in paddle handle operating mechanisms for latches and locks of the general type that form the subject matter of the following patents (referred to hereinafter as the Paddle Handle Operating Mechanism Patents) , the disclosures of which are incorporated herein by reference, namely: U.S. Pat. No. 5,439,260 issued Aug. 8, 1995 to Lee S. Weinerman et al, entitled HANDLE OPERABLE ROTARY LATCH AND LOCK; U.S. Pat. No. 5,595,076 issued Jan. 21, 1997 to Lee S. Weinerman et al, entitled HANDLE OPERABLE TWO-POINT LATCH AND LOCK; U.S. Pat. No. 5,611,224 issued Mar. 18, 1997 to Lee S. Weinerman et al, entitled HANDLE OPERABLE ROTARY LATCH AND LOCK; and U.S. Pat. No. 5,884,948 issued Mar. 23, 1999 to Lee S. Weinerman et al, entitled ROTARY LATCH AND LOCK. More particularly, the present invention relates to a more versatile form of paddle handle operating mechanism to which linkage may be connected for operating one or a plurality of remotely located latch assemblies, with the operating mechanism including, if desired, a lock that also may be accompanied by a handle disconnect mechanism.

2. Prior Art

Flush mountable, paddle-handle operated latches and locks are known that employ rotary latch bolts, also referred to as "rotary jaws," wherein the jaws are provided with U-shaped strike-receiving notches for latchingly receiving and releasably retaining suitably configured strike formations. Disclosures of latch and/or lock units of this type are found in U.S. Pat. No. 4,320,642 issued Mar. 23, 1982 to John V. Pastva, Jr., entitled PADDLE LOCKS WITH HANDLE DISCONNECT FEATURES; U.S. Pat. No. 4,917,412 issued Apr. 17, 1990 to Jye P. Swan et al, entitled VEHICLE DOOR LOCK SYSTEM PROVIDING A PLURALITY OF SPACED ROTARY LATCHES; U.S. Pat. No. 4,896,906 issued Jan. 30, 1990 to Lee S. Weinerman et al entitled VEHICLE DOOR LOCK SYSTEM; and, U.S. Pat. No. 5,069,491 issued Dec. 3, 1991 to Lee S. Weinerman et al entitled VEHICLE DOOR LOCK SYSTEM (referred to hereinafter as the Heavy Duty Rotary Latch and Lock Patents), the disclosures of which are incorporated herein by reference.

The rotary latch and/or lock units that are disclosed in the Heavy Duty Rotary Latch and Lock Patents are of a relatively heavy duty type that often are employed in "personnel restraint applications," typically on doors of passenger compartments of vehicles. These heavy duty units employ pairs of lousing-mounted rotary jaws, with the jaws being sandwiched between pairs of housing side plates, and with notches that are formed in each pair of rotary jaws being configured to receive and engage opposite sides of a suitably configured strike formation, typically a cylindrical stem of a striker pin. While both of the housing side plates are provided with U-shaped notches, neither of these notches defines a strike engagement surface that cooperates with a notched rotary jaw to latchingly receive and releasably retain a strike formation. The notches that are formed in the jaws, not the notches that are formed in the housing side plates, receive, engage and latchingly retain suitably configured strike formations.

Lighter duty rotary latch and lock units that employ single rotary jaws also are known. For example, U.S. Pat. No. 4,312,203 issued Jan. 26, 1982 to Edwin W. Davis entitled FLUSH-MOUNTABLE LOCK WITH ACTUATOR DISCONNECT FEATURE (referred to hereinafter as the Lighter Duty Rotary Latch and Lock Patent) discloses 1) the use of a single rotary latch jaw that is nested within and supported by portions of the housing of a flush mountable paddle-handle assembly, and 2) the use of a single U-shaped housing-carried notch that cooperates with the U-shaped notch formed in a rotary jaw to receive and latchingly retain a generally cylindrical strike formation. The disclosure of the Lighter Duty Rotary Latch and Lock Patent also is incorporated herein by reference.

So-called "paddle handle operating mechanisms" having flush-mountable, recess-defining, pan-shaped housings often are designed to accommodate a particular type of latch or a particular arrangement of remotely located latches. The limited amount of space that tends to be available for mounting these operating mechanisms within the confines of thin cabinet doors and the like has stood as an obstacle to the design of a versatile paddle handle operating mechanism that can be used with a wide variety of link-connected remotely located latches.

While manufacturers of paddle handle operating mechanisms have recognized the desirability of offering full-featured units (incorporating such options as "disconnects" for preventing handle movement from causing other operating components to move when the unit is locked) with a plurality of linkage connection points that will accommodate links coupled to a variety of arrays of remotely located latches, the constraints of available space have obstructed efforts to accommodate this objective. The need to minimize the thickness of the operating mechanisms (so they will fit within the confines of thin closures) is one such constraint. Others include a need to confine the operating components within the "footprint" of the generally rectangular pan-shaped housings on which the operating components are mounted so that the operating components can be inserted through rectangular door panel openings at the locations where the paddle handle operating mechanisms are to be mounted on closures.

If a paddle handle operating mechanism is to operate a pair of latches located on opposite sides of the mechanism (i.e., spaced from opposite sides or from opposite ends of the generally rectangular housing of the mechanism), connection points need to be provided near opposite sides of a centrally pivoted connection member so that the oppositely extending links (which extend in opposite directions from the connection member to operate the latches) will move substantially equidistantly in opposite directions when the latches are to be concurrently unlatched. The space that is needed to accommodate link-to-connection-member couplings is the same space that is competed for by other operating components that must be kept thin and held substantially within the footprint of the housing.

Attempting to use an existing paddle handle operating mechanism (that has been designed to accommodate one arrangement of remotely located latches) with a new arrangement of remotely located latches may result in non-concurrent latch operation and/or nonequidistant movement of the links that connect latches to the mechanism. This may cause one or both of the remotely located latches to fail to operate, to operate improperly or to be unduly stressed, with resulting damage and/or reduction in service life. A paddle handle operating mechanism that is provided with connections for links that operate a pair of remote latches located above and below the handle mechanism (i.e., spaced from opposite ends of the generally rectangular housing of the mechanism) may not be suited for operating a pair of remote latches located to the left and right of the handle mechanism (i.e., spaced from opposite sides of the generally rectangular housing of the mechanism), and seldom will be well suited for operating a pair of remote latches in a right-angle array wherein one of the latches is located above or below the handle mechanism, and another is located to the left or right of the handle mechanism.

Thus size constraints and other applicable design considerations have significantly obstructed efforts to provide a full-featured paddle handle operating mechanism with a pivoted connection member that defines a generous array of link connection points that are well suited for use with a good variety of link-operated latch arrays, including latch arrays having at least a pair of latches that are located on opposite sides of the paddle handle operating mechanism that are operated by links that move in opposite directions when the connection member pivots.

SUMMARY OF THE INVENTION

The present invention provides improvements that relate to paddle handle operating mechanisms of the type that are disclosed in the Paddle Handle Operating Mechanism Patents for operating latches and lock mechanisms of a variety of forms, such as those that are disclosed in all of the above-identified patents.

One of the improvements provided in accordance with the preferred practice of the present invention is a so-called "universal connection plate" to which a variety of simple and/or elaborate linkages may attach to drivingly connect the operating mechanism to one or a plurality of remotely located latch assemblies. The universal connection plate has a centrally located mounting hole that receives a support pin that mounts the connection plate for pivotal movement about a pivot axis that extends centrally through the mounting hole.

A feature of the universal connection plate is the novel arrangement of link connection points that it defines. Stated in another way, the connection plate is provided with a novel arrangement of strategically located connection formations such as holes. Elongate links can be connected to the connection plate at the locations of these holes to drivingly couple the connection plate to remotely located latches for operating the latches in response to pivotal movement of the connection plate about its pivot axis from a non-operated orientation to an operated orientation in response to pivoting of the handle of the operating mechanism from a non-operated position to an operated position.

A universal connection plate that embodies the preferred practice of the invention defines at least four connection formations, such as holes. First and second ones of these four connection formations are positioned generally on opposite sides of the pivot axis for connecting with and for oppositely moving a first pair of elongate opposed links for operating a first pair of latches that are spaced from opposite ends of the generally rectangular housing of the paddle handle operating mechanism. Third and fourth ones of these four connection formations are positioned generally on opposite sides of the pivot axis for oppositely moving a second pair of elongate opposed links for operating a second pair of latches that are spaced from opposite sides of the generally rectangular housing of the paddle handle operating mechanism.

In order to ensure that all four of the links that connect with the connection formations are caused to move substantially equidistantly in response to pivotal movement of the connection plate, it is optimal: 1) for the first and second connection formations to be located along an imaginary first line that intersects the pivot axis; 2) for the third and fourth connection formations to be located along an imaginary second line that intersects the pivot axis; 3) for all four of the connection formations to be located equidistantly from the pivot axis; and, 4) for the imaginary first and second lines to intersect substantially at right angles at the location of the pivot axis. While this very simple optimal approach can sometimes be utilized in laying out connection formation locations on a pivotal connection plate, it often is found that connection point locations laid out in this optimal way cause one or more of the connection points to be situated in precisely the same space that needs to be occupied by other more position-critical components of the operating position, or in space that needs to be kept open for required movements of such components.

Connection points defined by a universal connection plate must not be located within substantially the same space that needs to be occupied by other more critically positioned operating components of a full-function paddle handle operating mechanism. Moreover, in determining where connection points are to be located, it must be kept in mind that the link-to-plate connection-defining elements that will be installed at the selected connection point locations require substantial amounts of free space to accommodate their size and to accommodate the range of movements that they execute when the connection plate pivots about its pivot axis. Often optimal layouts of connection points simply are not acceptable, and at least one of the optimal connection point locations requires significant repositioning.

The present invention takes into account such design considerations and commonly encountered problems as are described above, and provides an approach that can be utilized to equip existing and new types of compactly-designed, full-featured paddle handle operating mechanisms with universal connection plates that have connection formation arrays that can operate 1) a first set of oppositely acting links for releasing latches spaced from opposite ends of the rectangular housing of the paddle handle operating mechanism, and 2) a second set of oppositely acting links for releasing latches spaced from opposite sides of the rectangular housing of the paddle handle operating mechanism, with all four of the links being moved substantially equidistantly to effect proper concurrent latch operation in response to pivotal movement of the connection plate from a non-operated orientation to an operated orientation in response to movement of the handle from a non-operated position to an operated position.

As will be explained in greater detail later herein, in accordance with the preferred practice of the present invention, a novel array of connection formations are provided on universal connection plates to define a plurality of connection points for lengthy links that can be used to couple the connection plates to various arrays of remotely located latches. By limiting the ranges of angular movement of the connection plates, and by using links that are relatively lengthy (in comparison with the distances of the connection points from the pivot axes of the connection plates), it is possible to simplify the way in which connection point locations are chosen so that connection plates of a variety of configurations can be provided that will accommodate the presence of other components and that will permit existing and new types of paddle handle operating mechanisms to be equipped with a universal connection plate while still complying with use space restrictions, and without sacrificing the degree of link connection versatility that is offered by the connection plates.

A feature of a universal connection plate that embodies the preferred practice of the invention, resides in its definition of pairs of linkage connection holes that are arranged "substantially symmetrically" (but not necessarily "exactly symmetrically") on opposite sides of the centrally located pivot axis of the connection plate. The linkage connection holes define "connection formations" for receiving pins that pivotally couple the connection plate to elongate links that typically extend in opposite directions and/or in right angle orientations away from the pivot axis for operating pairs or groups of latch mechanisms that are located on opposite sides of and/or in right angle relationships relative to the paddle handle operating mechanism. By properly positioning the connection holes, the links that couple with the connection plate can be made to move concurrently through substantially equal distances (measured along their lengths) to properly and concurrently operate latches that are connected to these links.

Still another feature that adds versatility resides in the provision of a paddle handle operating mechanism that permits a very basic, straight-forward type of operating linkage for drivingly connecting the pivotal paddle handle with the universal connecting plate to be replaced, if desired, by a more full-featured paddle handle operating mechanism that incorporates a "handle disconnect" feature for disconnecting the universal connection plate from the paddle handle when the lock is "locked" to prevent efforts to force the paddle handle from succeeding in unlatching the remotely positioned latch assemblies in response to unlatching movement of the connection plate.

In accordance with preferred practice, if a operating handle mechanism is to include a handle disconnect feature, the type of operating handle disconnect linkage that is employed preferably is of the general type disclosed in the referenced First and Second Disconnect Cases, and the previously mentioned provisional application that addressed these same inventions, namely application Serial No. 60/115,797.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
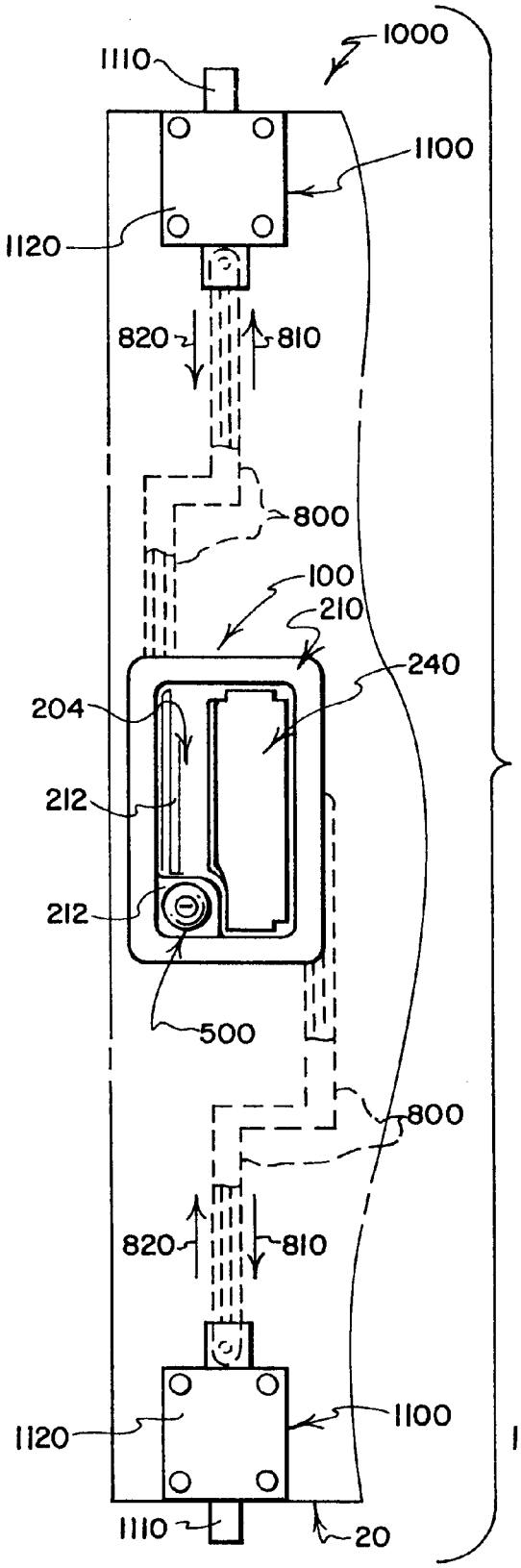
FIG. 1 is front side elevational view of one form of a plural-point door latch that has a lockable flush-mountable paddle handle operating mechanism that incorporates features of the present invention, with portions of two elongate links that interconnect the operating mechanism with a pair of remotely located slide bolt latch assemblies being foreshortened, and with portions of a door on which the lock is mounted being outlined in phantom.
Figure 2:
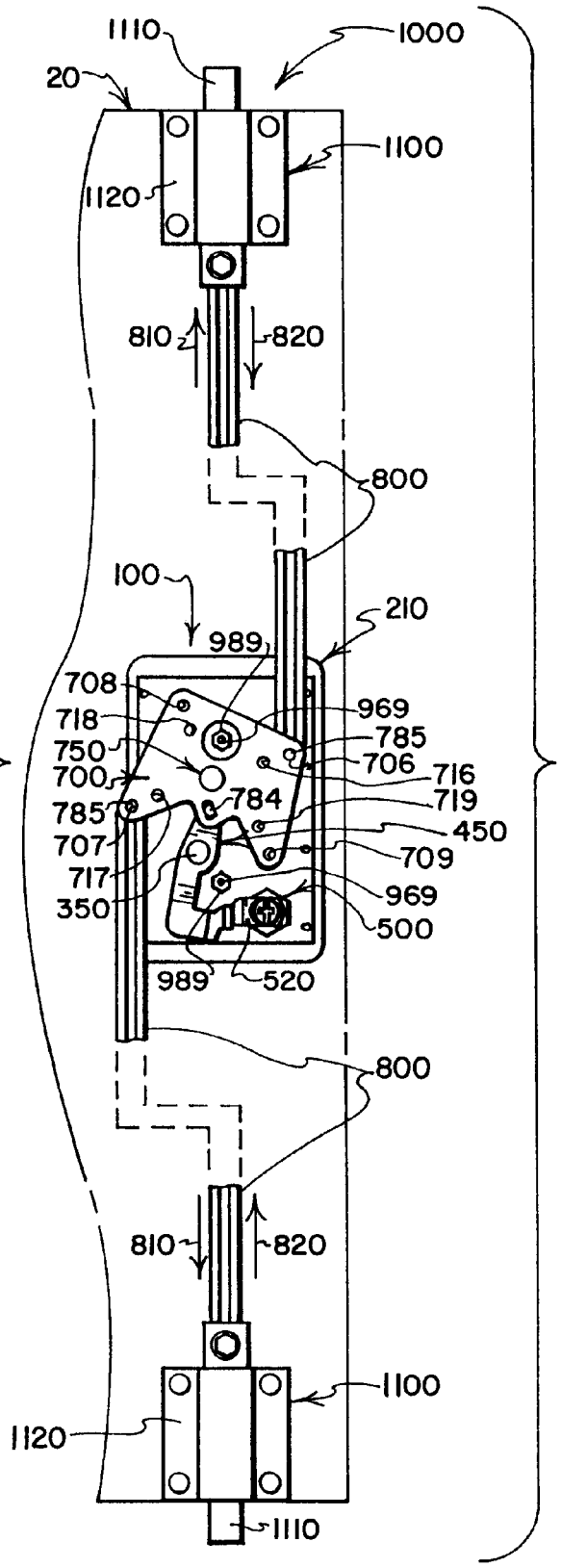
FIG. 2 is a rear side elevational view thereof.
Figure 3:
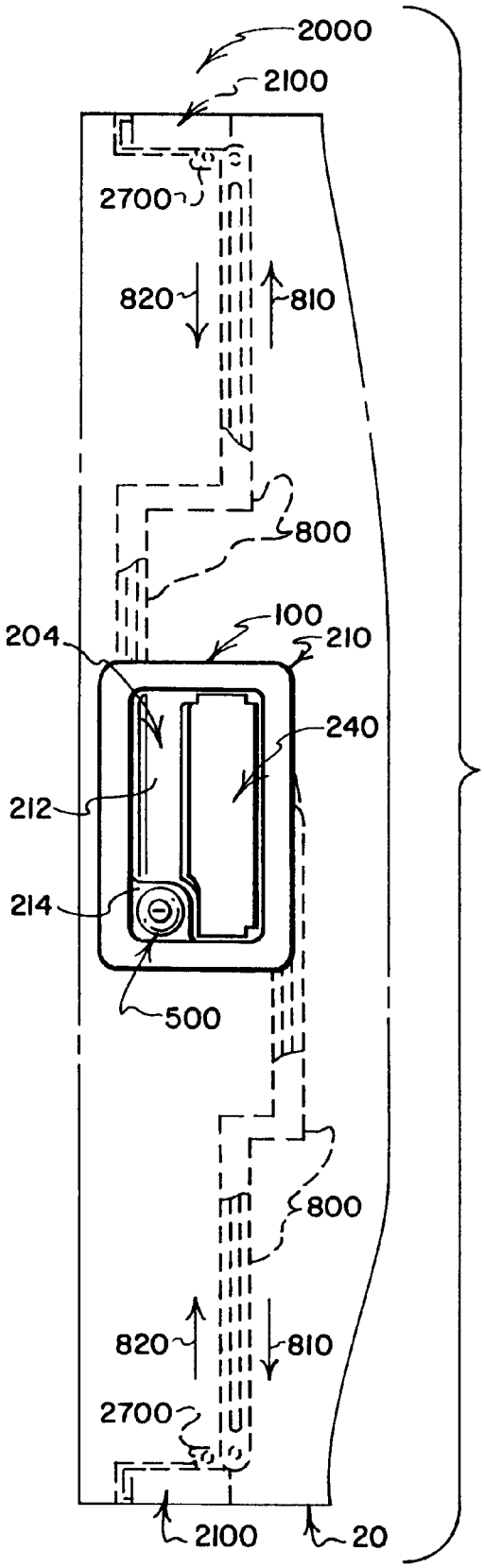
FIG. 3 is a front side elevational showing another form of plural-point door latch that utilizes the same lockable flush-mountable paddle handle operating mechanism, with portions of two elongate links that interconnect the operating mechanism with a pair of remotely located rotary latch assemblies being foreshortened, and with portions of a door on which the lock is mounted being outlined in phantom.
Figure 4:
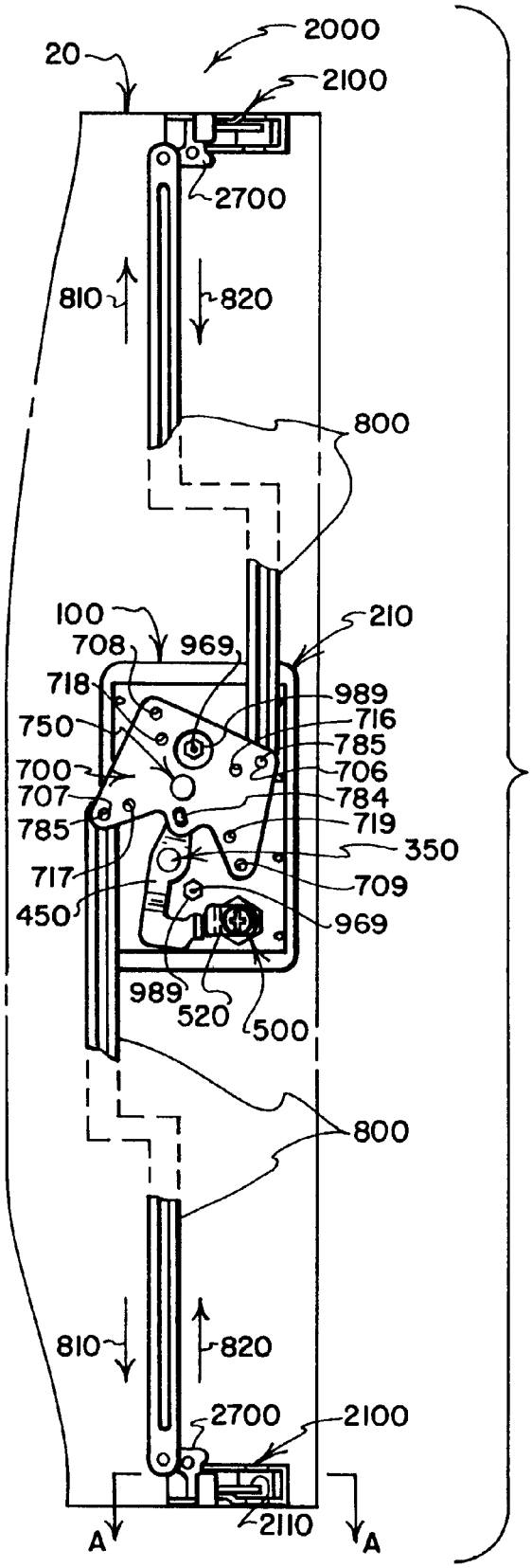
FIG. 4 is a rear side elevational view thereof.

In the description that follows, the discussion that is associated with FIGS. 1 and 2 relates to a first embodiment of a "plural-point" door lock that is indicated generally by the numeral 1000; and, the discussion that is associated with FIGS. 3 and 4 relates to a second embodiment of a "plural-point" door lock that is indicated generally by the numeral 2000. The lock embodiments 1000, 2000 are substantially identical except that the first lock embodiment 1000 utilizes a pair of identical latch assemblies 1100 that have spring-projected slide-type latch bolts 1110, while the second lock embodiment utilizes a pair of rotary latch assemblies 2100 that are substantially identical (a difference being that each is a "mirror image reversal" of the other, whereby one is said to be "left" and the other is said to be "right") and have rotary latch bolts 2110 (best seen in FIGS. 16–21). The first and second lock embodiments 1000, 2000 utilize identical lockable paddle-handle operating mechanisms 100, features of which are depicted in FIGS. 5–14.

Figure 22:
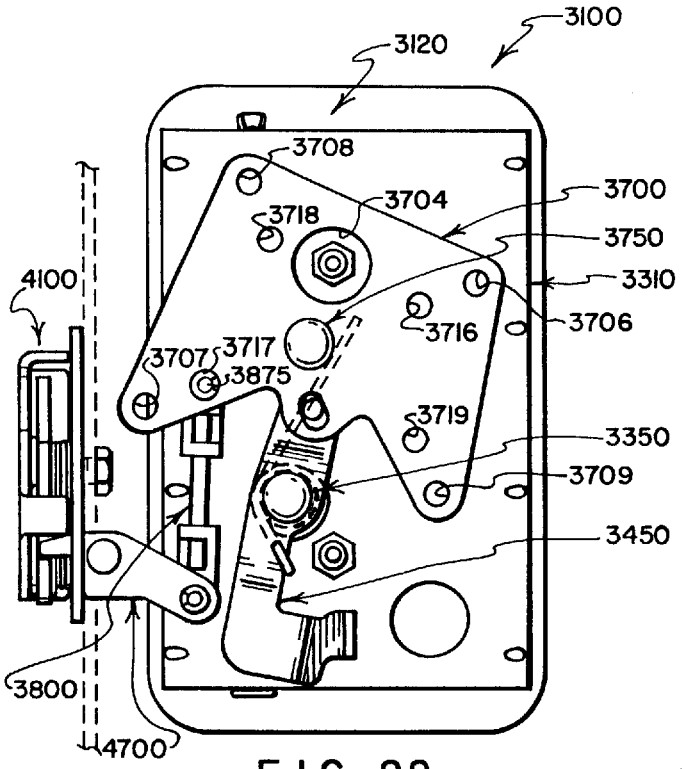
FIG. 22 is a rear side elevational view of a non-locking paddle handle operating mechanism that is substantially identical to the paddle handle operating mechanism disclosed in FIGS. 5–14 except for the absence of a key-operated lock cylinder assembly, shown connected to a rotary latch of the type depicted in FIG. 17 but having a slightly differently configured operating arm.

A non-locking form of paddle handle operating mechanism is depicted in FIG. 22, as indicated by the numeral 3100. The only difference between the operating mechanisms 100, 3100 is that the lockable mechanism 100 includes a key-operated lock cylinder assembly 500, whereas the non-lockable mechanism 3100 includes no lock cylinder. In FIG. 22, a rotary latch assembly 4100 is shown connected to the operating mechanism 3100 by a link 3800. The only difference between the rotary latch assemblies 2100, 4100 is that the rotary latch assembly 4100 employs a slightly differently configured operating arm 4700 (as can be seen by comparing its shape with the operating arm 2700 seen best in FIG. 17). To avoid the need to repeat portions of the description that follow in describing the substantially identical operating mechanisms 100, 3100, "corresponding reference numerals" are used in FIG. 22 to designate components of the operating mechanism 3100 (the numerals are larger by a magnitude of three thousand) than "corresponding reference numerals" that are used in FIG. 7 to designate identical components of the operating mechanism 100.

Figure 23:
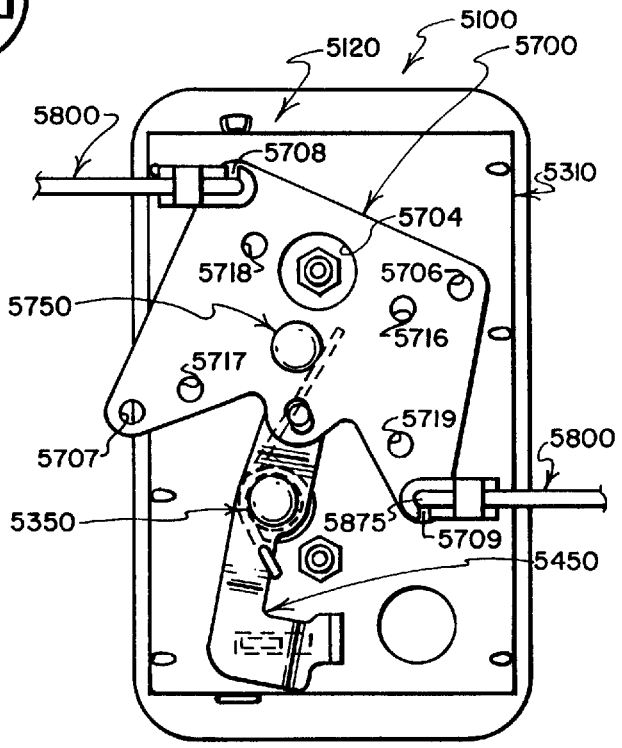
FIG. 23 is a rear side elevational view of the non-locking paddle handle operating mechanism of FIG. 22 shown connected to a pair of latch operating links that extend away from the paddle handle operating mechanism in directions that differ from the directions in which a pair of latch operating links extend away from the paddle handle operating mechanisms depicted in FIGS. 2 and 4.

In FIG. 23, a non-locking paddle handle operating mechanism 5100 is shown that is identical to the non-locking operating mechanism 3100. In FIG. 23, a pair of latch operating links 5800 are shown connected to the operating mechanism 5100 that extend in different opposed directions (namely in directions extending away from opposite sides of the generally rectangular housing of the paddle handle operating mechanism 5100) than the links 800 shown in FIGS. 1–4 (wherein it will be seen that the links 800 extend away from opposite ends of the paddle handle operating mechanism 100). What the links 800 (of FIGS. 1–4) and the links 5800 (of FIG. 23) clearly illustrate is that the identical paddle handle operating links that are relatively lengthy (in comparison with the mechanisms 100, 5100 offer the versatility of being able to oppositely move pairs of elongate opposed links 800, 5800 to concurrently operate remotely located latches regardless of whether the latches are spaced from opposite ends or from opposite sides of the generally rectangular housings of the identical paddle handle operating mechanisms 100, 5100.

As will be explained in greater detail in conjunction with FIGS. 25 and 26 (wherein the layout and operation of the identical universal connection plates 700, 5700 of the substantially identical paddle handle operating mechanisms 100, 5100 is shown and described in greater detail), identical pivotal movements of the identical connection plates 700, 5700 will cause the links 800, 5800 to move equal amounts (as measured along the lengths of these links). Because equal pivotal movements of the connection plates 700, 5700 produce substantially equal distance movements of the links 800, 5800 (as measured along the lengths of these links), a selected one of the substantially identical paddle handle operating mechanisms 100, 5100 can be utilized (if desired) to concurrently operate not only a first pair of latches (that are spaced from opposite ends of the housing of the selected mechanism 100, 5100) but also a second pair of latches (that are spaced from opposite sides of the housing of the selected mechanism 100, 5100) if both pairs of the links 800, 5800 are connected to the universal connection plate thereof (as is depicted schematically in FIGS. 25 and 26). This "equal-connection-plate-rotation results in equal-link-movement for opposed sets of links coupled to latches spaced from opposite ends and/or spaced from opposite sides" feature is one of the reasons why paddle handle operating mechanisms that embody the preferred practice of the present invention are well suited for operating a wide and versatile variety of latch arrangements.

Figure 7:
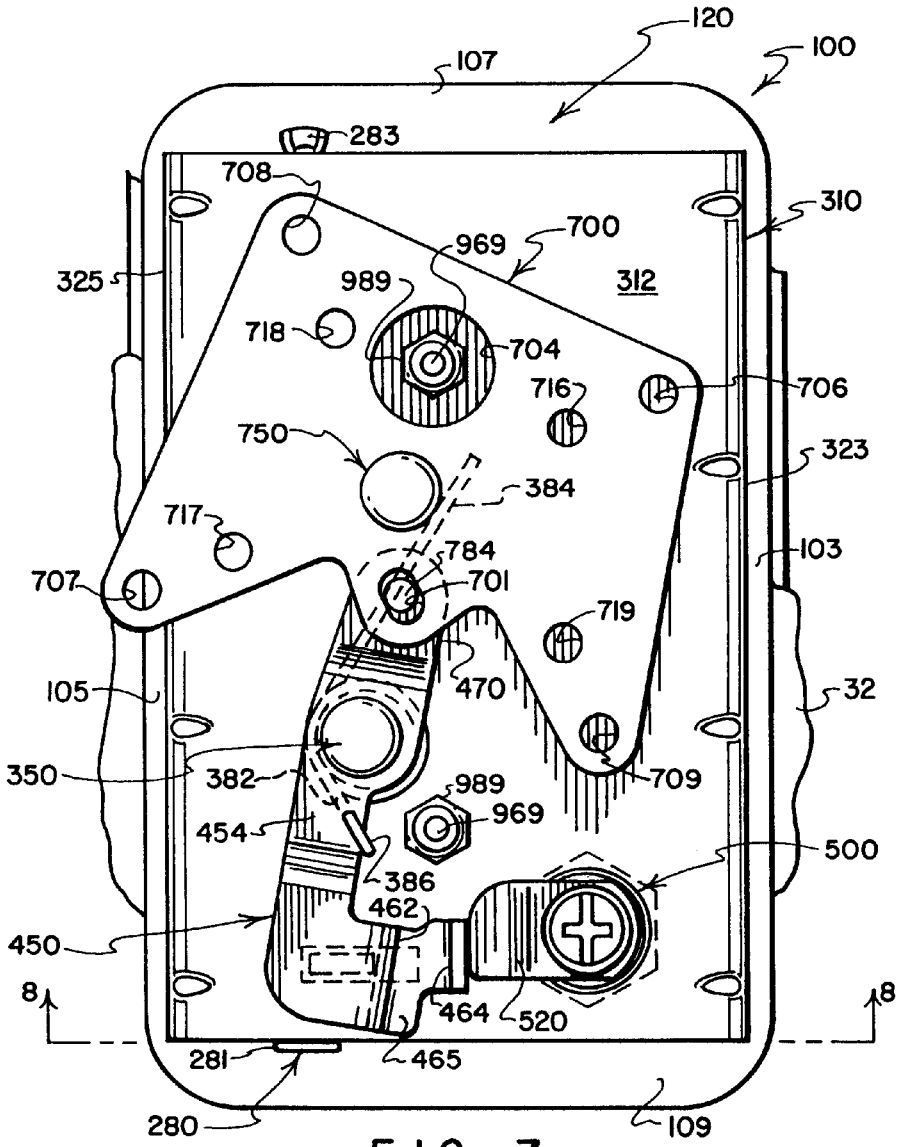
FIG. 7 is a bottom plan view thereof, with relatively movable components positioned as is depicted in FIGS. 5 and 6, with a cam of a key-operated lock assembly shown in solid lines in its locked position and shown in phantom in its unlocked position.

To avoid the need to repeat portions of the description that follow in describing the substantially identical operating mechanisms 100, 5100, "corresponding reference numerals" are used in FIG. 23 to designate components of the operating mechanism 5100 (the numerals are larger by a magnitude of five thousand) than "corresponding reference numerals" that are used in FIG. 7 to designate identical components of the operating mechanism 100. Likewise, in FIGS. 24 and 27–32 where more full-features paddle handle operating mechanisms 6100, 7100 are depicted (that include disconnect linkages for preventing handle movement from pivoting their connection plates 6700, 7700 when the mechanisms 6100, 7100 are locked), "corresponding numerals" are utilized (to designate corresponding components) that differ by magnitudes of six thousand and seven thousand, respectively, from the numerals that are used to designate corresponding components of the paddle handle operating mechanism 100.

While rigid, elongate links 800 (typically formed as stampings from metal) are depicted in FIGS. 1–4 as being utilized to connect the operating mechanisms 100 to the latch assemblies 1100, 2100, those who are skilled in the art will understand that a variety of other types of linkage (e.g., including flexible links comprised of chain or woven steel cable, not shown and rod-like links such as those indicated in FIGS. 22 and 23 by the numerals 3800, 5800) may be substituted for the links 800. While the links 800 of the lock embodiments 1000, 2000 connect with the operating mechanisms 100 in a manner that permits the operating mechanisms 100 to exert a "tension" or "pulling" type of force along the links 800, those who are skilled in the art will understand that the operating mechanism 100 also is well suited for use in applying a "compression" or "pushing" type of force (along a set of suitably rigid links, not shown) to operate such latch mechanisms as may require this type of force application to unlatch a variety of commercially available latch mechanisms.

While the operating mechanism 100 is depicted in the drawings as employing pairs of links 800 that connect with only two of the latches 1100, or with only two of the latches 2100, those which are skilled in the art will understand that suitable linkage may be substituted for one or both of the links 800 for connecting the universal connection plate 700 of the operating mechanism 100 with a larger number of latches (not shown) to effect concurrent "unlatching" of more than two latches. Thus, while the drawings depict latches 1100 having spring-projected slide bolts 1110 and latches 2100 having rotary latch bolts 2110, it will be understood that the operating mechanism 100 may be used with other types of commercially available latch assemblies, and with numbers of latch assemblies that differ from "two." In FIGS. 25 and 26, for example, a connection plate designated by the numeral 700 is shown connected to a first pair of links 800 (schematically depicted, but being of the type indicated by the numeral 800 in FIGS. 1–4) and to a second pair of links 5800 (schematically depicted, but being of the type indicated by the numeral 5800 in FIG. 23). If the operating mechanism 100 is to be utilized with rotary latch assemblies to form a two-point lock (such as the lock 2000 that is depicted in FIGS. 3 and 4), the best mode known to the inventors for carrying out the preferred practice of the present invention calls for the operating mechanism 100 to be of the type that is depicted in FIGS. 5–14, and for the rotary latches to be of the type depicted in FIGS. 16–21.

Figure 15:
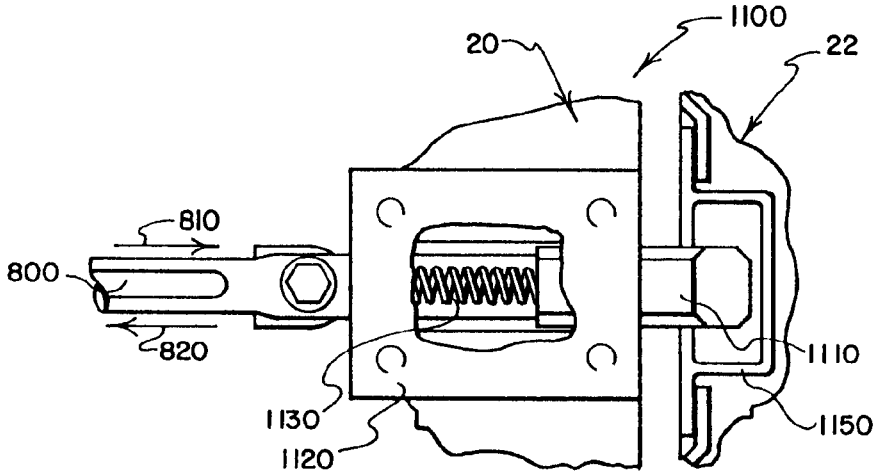
FIG. 15 is a front side elevational view, on an enlarged scale, of one of the latch bolt assemblies that is utilized in the plural-point latch system depicted in FIGS. 1 and 2, together with portions of an associated strike and portions of a door frame on which the strike is mounted, with portions thereof broken away to permit underlying features to be seen.

Referring to FIGS. 5–11, the flush-mountable operating mechanism 100 is shown mounted on a door or closure 20. The closure 20 typically is formed-from at least one stamped metal sheet 32 (or as a welded assembly of metal sheets, not shown), with a generally rectangular mounting openings 34 (see FIGS. 8, 10 and 11) being provided, through which portions of the operating mechanism 100 project. The closure 20 is movable between open and closed positions with respect to nearby structure such as a door frame, portions of which are depicted in FIG. 15, as indicated by a numeral 22.

Figure 11:
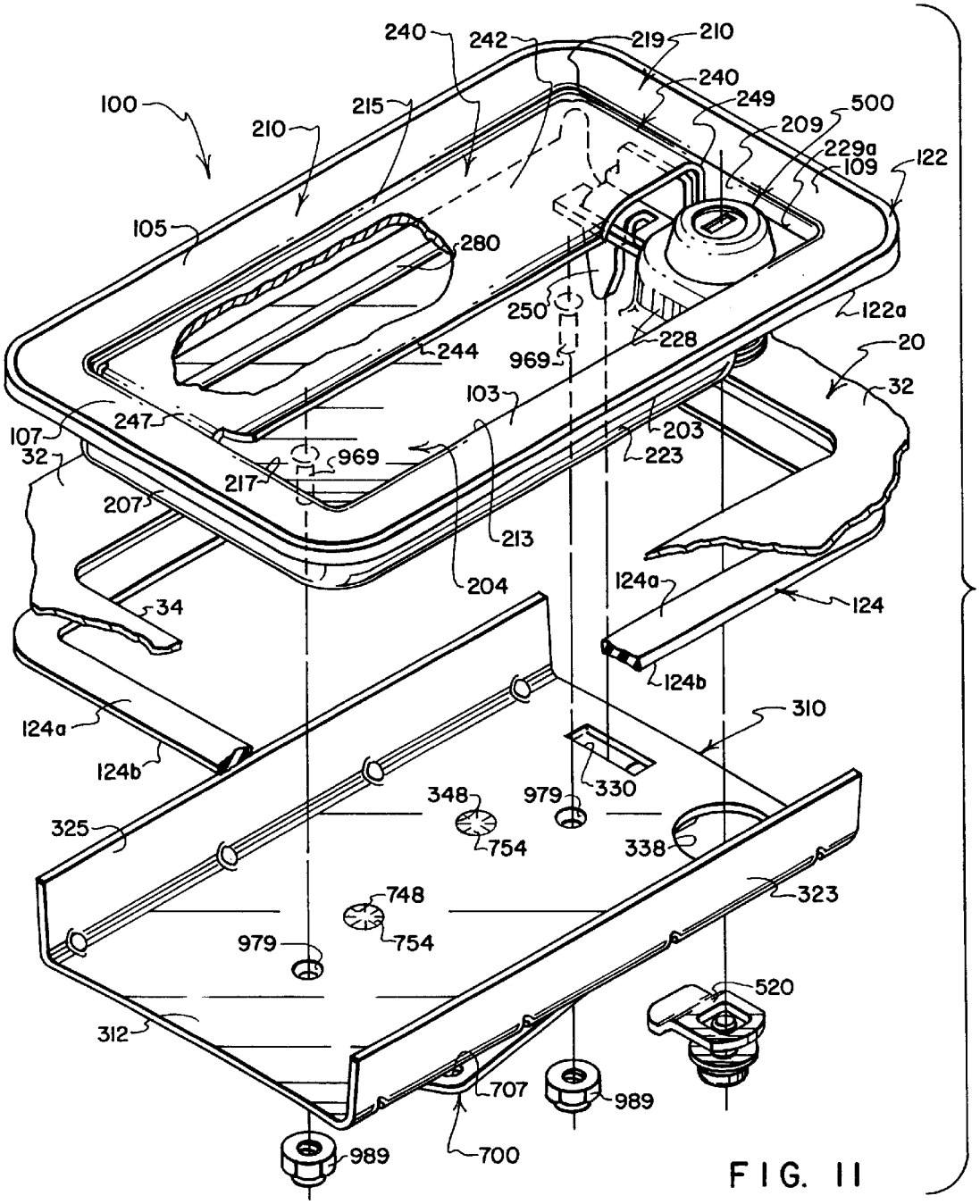
FIGS. 11, 12 and 13 are exploded front perspective views of selected components of the paddle handle operating mechanism of FIGS. 5–10, with some components separated so as to be depicted individually, with other components shown assembled, and with some component portions broken away to permit underlying features to be viewed.
Figure 12:
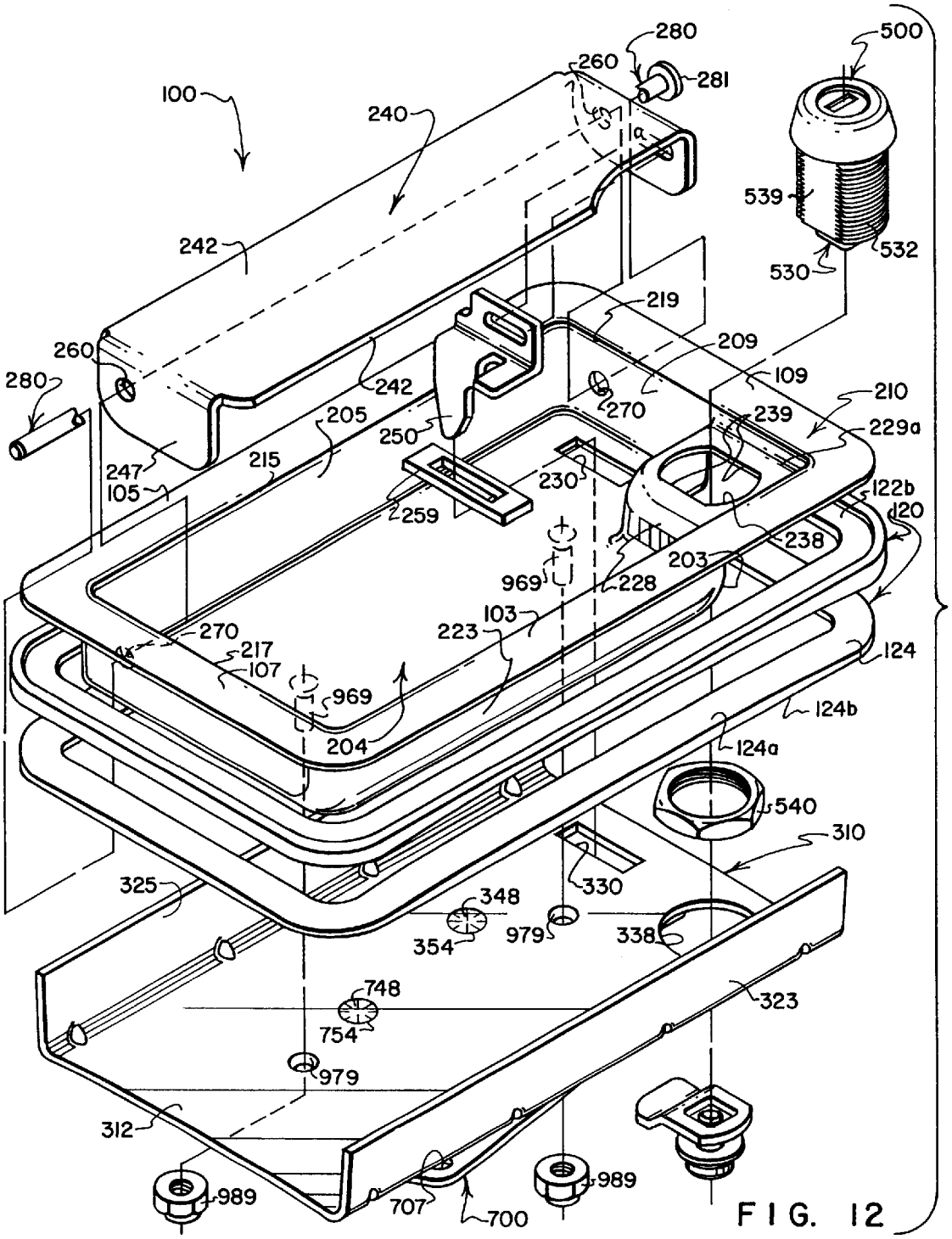

While the metal sheet 32 of the closure 20 is depicted in the drawings (see FIG. 6) as having a very slight outwardly convex curvature (which is dealt with by providing a gasket set 120—including an outer gasket 122 and an inner gasket 124 that have complementarily curved surfaces 122*a*, 124*a* and opposed flat surfaces 122*b*, 124*b*, as best seen in FIGS. 11 and 12—that permits the operating mechanism 100 to be installed with a proper weather-tight seal being established about the mounting opening 34), those who are skilled in the art will understand that the operating mechanism 100 also can be installed in a mounting opening formed through a flat sheet (not shown) simply by substituting for the special gasket set 120 a simple, conventional, flat gasket (not shown) to surround the mounting opening and to underlie the flat mounting flange 202 of the pan-shaped housing 210 of the operating mechanism 100. A more complete discussion of the provision of special, curvature-accommodating gaskets vs. simple flat gaskets is provided in the referenced Companion Utility Case, the disclosure of which is incorporated herein by reference.

Figure 13:
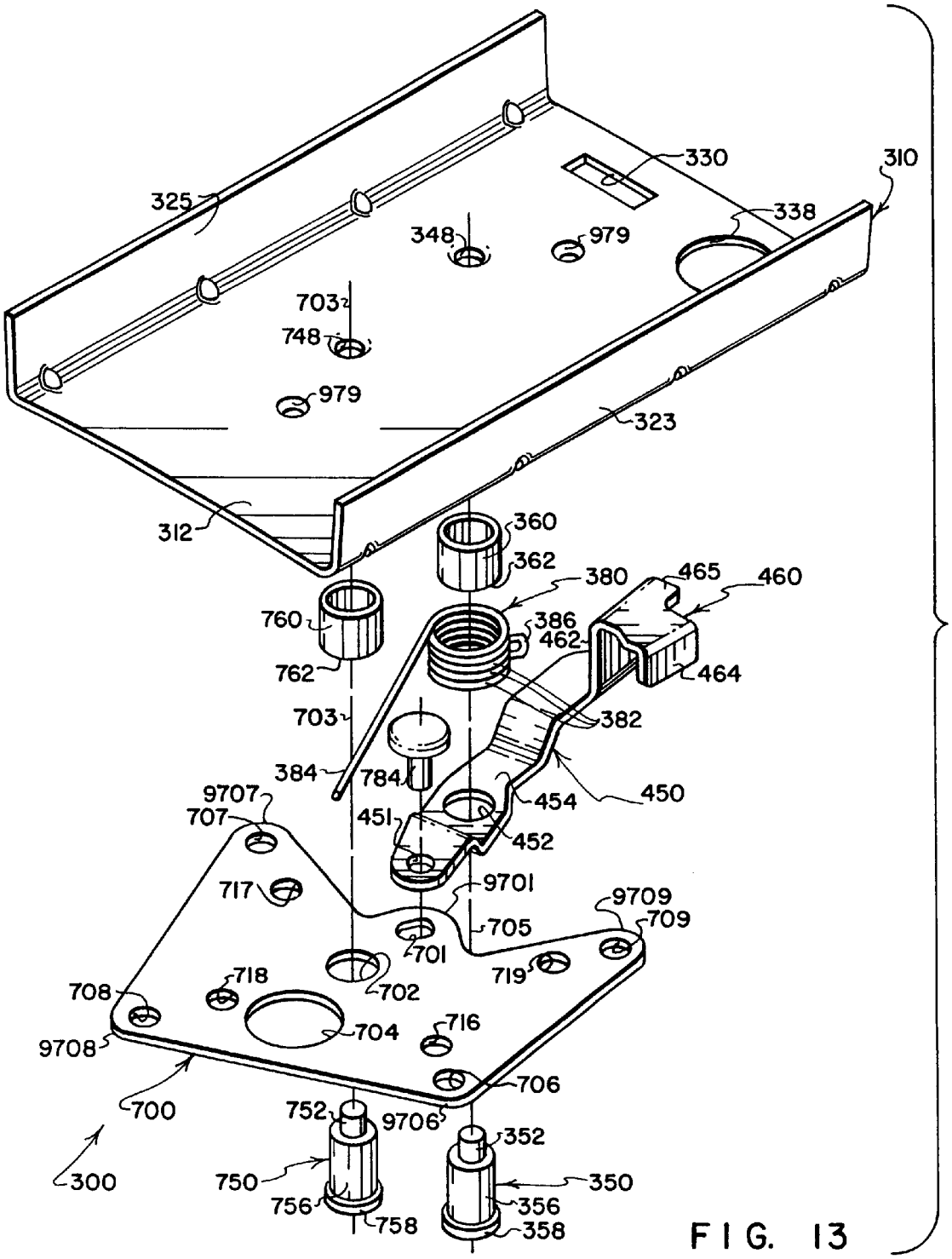
Figure 14:
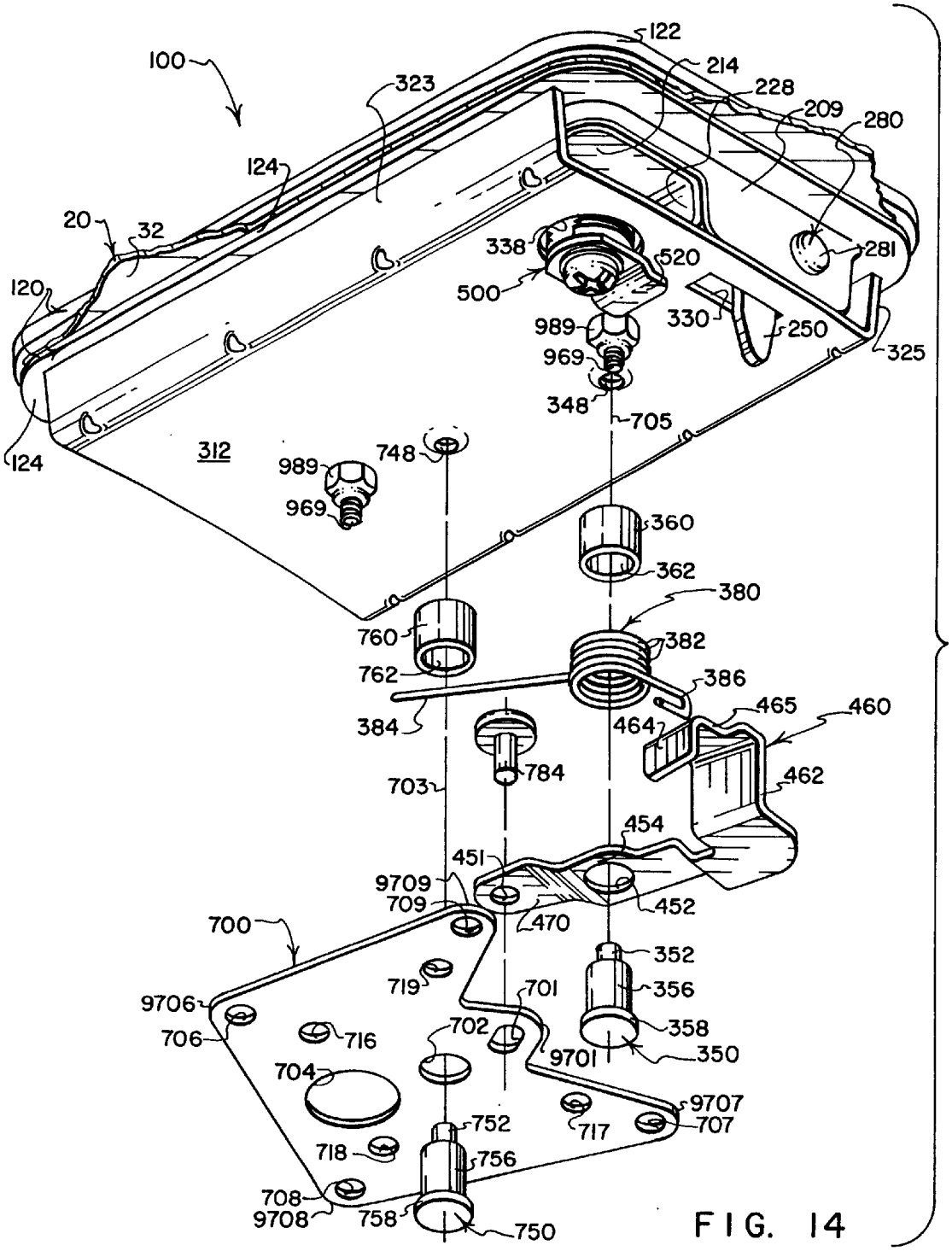
FIG. 14 is an exploded rear perspective view showing selected components of the paddle handle operating mechanism of FIGS. 1–13, with some components separated so as to be depicted individually, and with other components shown assembled.

Three modular assemblies 200, 300, 500 form the operating mechanism 100. Referring to FIGS. 11 and 12, a pan-shaped housing 210, a paddle-shaped handle 240, a hinge pin 280, and a torsion coil spring 290 comprise what will be referred to as a "front mountable modular assembly" or "handle and housing assembly" 200. Referring to FIGS. 13 and 14, a mounting bracket 310, an operating arm 450, and a universal connection plate 700 (that connects with the links 800) comprise what will be referred to as a "rear mountable modular assembly" or "bracket, latch and linkage assembly" 300. Referring to FIGS. 11, 12 and 14, a "third modular assembly" takes the form of a conventional, commercially available, "key operated cam lock assembly" 500 that can be operated by a suitably configured key 510 (see FIGS. 8 and 10 wherein the bow of the key 510 is shown projecting forwardly from the cam lock assembly 500).

Figure 5:
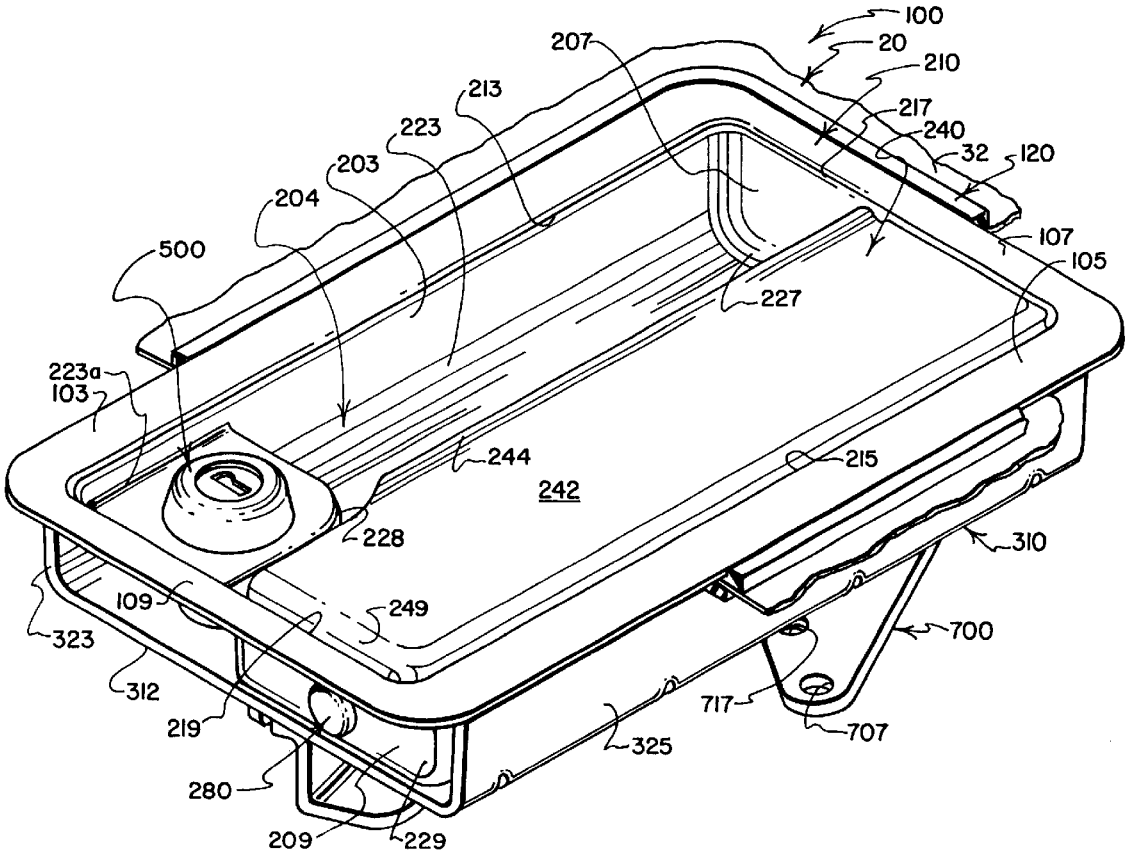
FIG. 5 is a perspective view of the lockable flush-mountable paddle handle operating mechanism that is used with the first and second plural-point latch systems shown mounted on a slightly curved portions of a closure.
Figure 6:
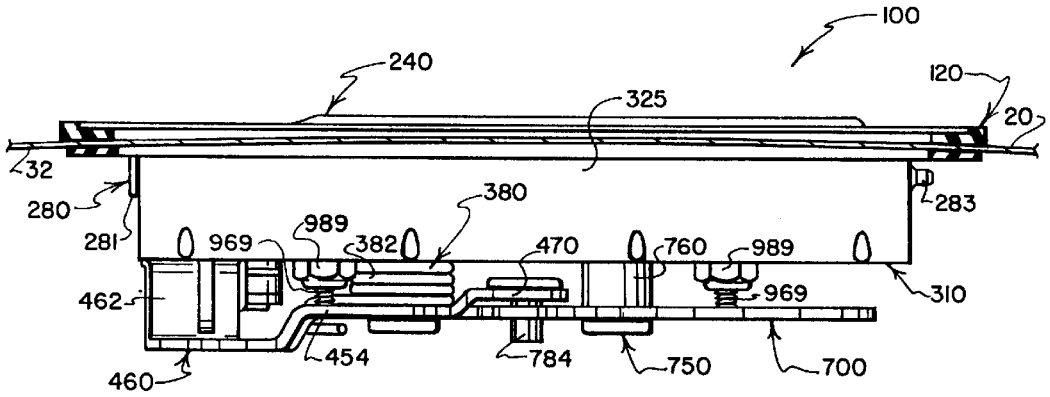
FIG. 6 is a side elevational view thereof.

Turning to features of the "front mountable modular assembly" or "handle and housing assembly" 200, and referring to FIGS. 5, 11 and 12, the pan-shaped housing 210 is a generally rectangular metal stamping having a perimetrically extending, substantially flat mounting flange 202 which surrounds a forwardly facing recess 204. Opposed, relatively long side walls 203, 205, and opposed, relatively short end walls 207, 209 are joined by small radius bends 213, 215, 217, 219 to the flat mounting flange 202.

A majority of the recess 204 is relatively deep, and is closed by a main back wall portion 212 that is substantially flat. A corner region of the recess 204 located near the juncture of the side and end walls 203, 209 is more shallow, and is closed by a minor back wall portion 214 that also is substantially flat. Relatively small radius bends 223*a* (FIG. 5), 229*a* (FIGS. 11–12) join portions of the side and end walls 203, 209 to the minor back wall portion 214. A curved wall 228 joins the minor back wall portion 214 to the main back wall portion 212, with small radius bends being provided where the curved wall 228 joins with the back wall portions 212, 214. Referring variously to FIGS. 5, 11 and 12, relatively small radius bends 225, 227, 229 join portions of the side and end walls 205, 207, 209 to the main back wall portion 212. A relatively larger radius bend 223 joins portions of the side wall 203 to the main back wall portion 212.

Referring to FIG. 12, a main back wall opening 230 is formed through the main back wall portion 212; and, a lock mount opening 238 is formed through the minor back wall portion 214. The main back wall opening 230 is elongate, generally rectangular, is spaced a short distance from the housing end wall 229, and extends parallel to the housing end wall 229. The lock mount opening 238 is generally circular except for two flats 239 formed along opposite sides thereof. In the non-locking embodiments 3100, 5100 depicted in FIGS. 22 and 23, respectively, there is no corresponding lock mounting opening.

Referring principally to FIGS. 11 and 12, the paddle-shaped handle 240 has a generally rectangular front wall 242 with a forwardly-turned lip 244 formed along one edge. Rearwardly-turned end flanges 247, 249 border opposite ends of the rectangular front wall 242 and extend alongside the housing end walls 207, 209, respectively. The end flange 249 has an inwardly-turned extension 248 that parallels the front wall 242 of the handle 240, and that carries a rearwardly projecting tab-like formation 250 that extends through the main back wall opening 230. Referring to FIG. 12, an optional, generally rectangular gasket 259 may be provided to surround portions of the projection 250 at a location adjacent the back wall opening 230.

Referring to FIG. 12, the hinge pin 280 extends through aligned holes 260 that are formed through the end walls 207, 209 of the pan-shaped housing 210, and through aligned holes 270 that are formed through the rearwardly-turned flanges 247, 249 of the paddle-shaped handle 240 to pivotally mount the handle 240 on the housing 210. A head 281 is formed on one end of the pin 280. While the opposite end of the pin initially is pointed (as depicted in FIG. 12) to facilitate assembly, once the pin 280 has been inserted through the holes 260, 270 to pivotally mount the handle 240 on the housing 210, a crimp 283 is formed (see FIG. 7) to prevent removal of the pin 280 from the holes 260, 270.

Figure 8:
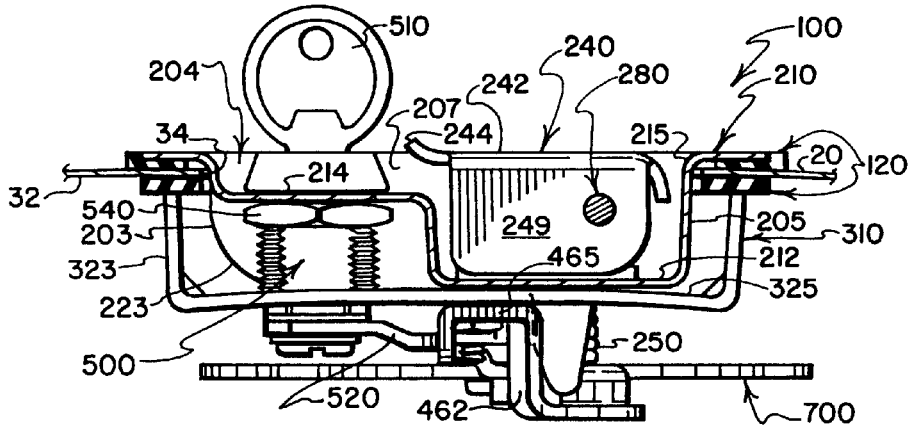
FIG. 8 is a sectional view as seen from a plane indicated by a line 8—8 in FIG. 7, but with a key inserted in the key-operated lock assembly.

Referring to FIGS. 11 and 12, the torsion coil spring 290 has a coiled central region 292 that extends loosely about the hinge pin 280 at a location between the rearwardly-turned flanges 246 of the handle 240, and has opposed end regions 294, 296 that engage the back wall 212 and the handle 240, respectively, to bias the handle 240 away from its "extended" or "operated" position (see FIG. 10) toward its "nested" or "non-operated" position (see FIGS. 5, 8 and 11).

Figure 9:
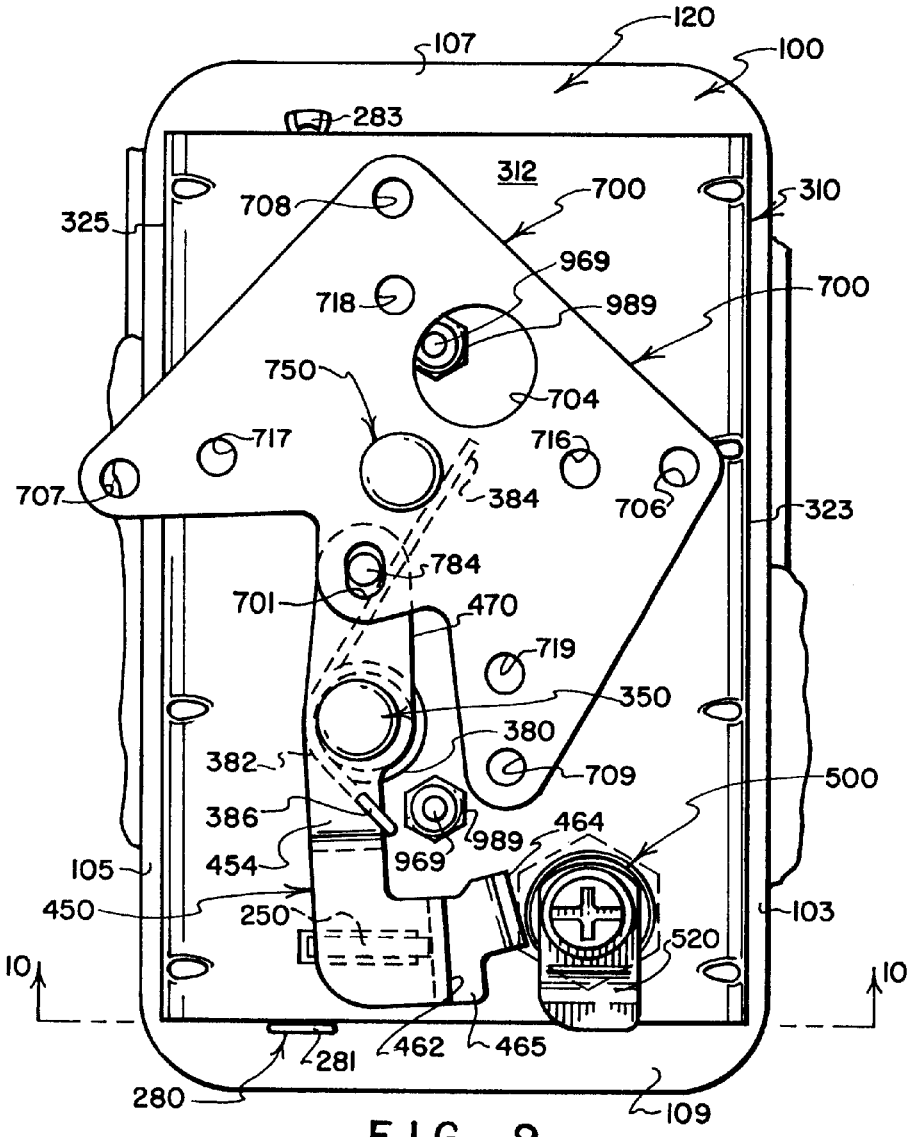
FIG. 9 is a bottom plan view similar to FIG. 7 but with the cam of the lock assembly in its unlocked position, and with an operating handle of the operating mechanism in an operated position that causes an operating arm to pivot a T-shaped lever for moving elongate links of the type used with the first and second lock embodiments.
Figure 10:
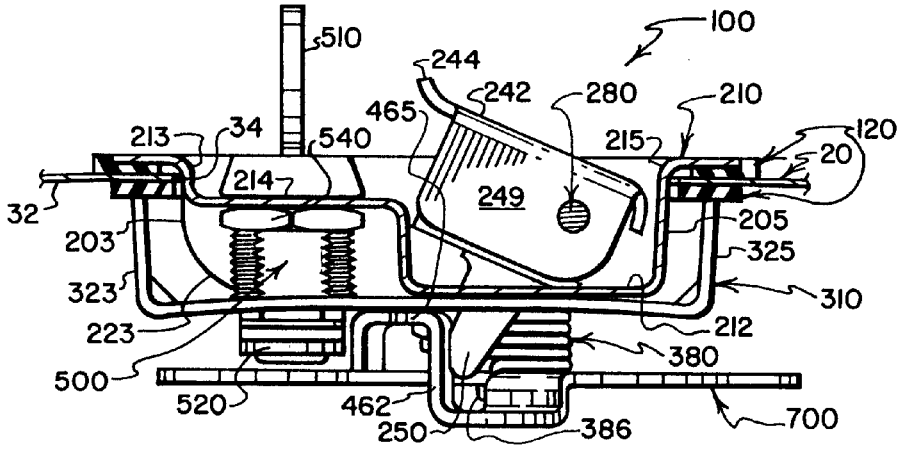
FIG. 10 is a sectional view as seen from a plane indicated by a line 10—10 in FIG. 9.

When the operating handle 240 is moved away from its nested, non-operated position toward its extended, operated position (by pivoting about the axis of the pin 280), the rearwardly extending handle tab projection 250 is caused to move within the back wall opening 230 (from a normal or "first" position that is depicted in FIG. 8 to a "second" position that is depicted in FIG. 10). As will be explained shortly, this movement of the tab 250 within the confines of the back wall opening 230 causes the operating arm 450 to move from a normal or "primary" position of the operating arm 450 (depicted in FIGS. 7 and 8) to a "secondary" position of the operating arm 450 (depicted in FIGS. 9 and 10).

Turning now to features of the "rear mountable modular assembly" or "bracket, latch and linkage" assembly 300, and referring to FIGS. 11–14, the mounting bracket 310 has a relatively flat, generally rectangular-shaped central region 312 with a forwardly turned side flanges 323, 325 configured to extend along the full lengths of the housing side walls 203, 205 when the front and rear modules 200, 300 are assembled).

An elongate, generally rectangular opening 330 is formed through the flat central portion 312 of the mounting bracket 310 to align with the main back wall opening 230 when the mounting bracket 310 is mounted together with the handle and housing assembly 200 on the closure 20—which alignment is provided to enable the the rearwardly projecting formation 250 of the handle 240 to extend through the opening 330 to engage the operating arm 450. A feature that is provided by the closely spaced, aligned housing and mounting bracket openings 230, 330 is that they cooperate to protectively enshroud the rearwardly projecting formation 250 to prevent it from bending or breaking either during normal service or as the result of tampering.

Optionally formed through the flat central portion 312 of the mounting bracket 310 is a circular opening 338 that is located to align with the lock mounting opening 238 of the pan-shaped housing 210 to permit the lock assembly 500 to pass therethrough in a close fit. A feature that is provided by the close fit of the circular opening 338 about body portions of the lock assembly 500 is that the material of the mounting bracket 310 that extends about the opening 338 will help to reinforce and rigidify the mounting of the lock assembly 500 in the lock mounting opening 238 to prevent damage from occurring due either to extensive normal service or as the result of tampering or forcing of the operating mechanism 100.

Referring to FIG. 13, tapered holes 348, 748 are formed through the flat central portion 312 of the mounting bracket 310 to receive reduced diameter end regions 352, 752 of mounting posts 350, 750, respectively. The mounting posts 350, 750 are rigidly attached to the mounting bracket 310 by deforming and expanding the reduced diameter end regions 352, 752 to form an enlarged heads 354, 754 that substantially fill the tapered holes 348, 748, as is depicted in FIGS. 11 and 12.

Referring to FIGS. 13 and 14, the mounting post 750 has a centrally extending first pivot axis 703, and the mounting post 350 has a centrally extending second pivot axis 705. The mounting bracket 310 and the mounting post 750 connected thereto define what can be referred to as a "means" that is connected to the housing 210 and that defines a rearwardly extending pivot axis (namely the first pivot axis 703 that extends centrally through the mounting post 750). The mounting posts 350, 750 have generally cylindrical central regions 356, 756 that extend rearwardly to where enlarged heads 358, 758 are formed, respectively. Sleeves 360, 760 are mounted in a slip fit on the central regions 356, 756 and extend rearwardly from the flat central wall 312 of the mounting bracket 310 to define ends 362, 762 that are spaced short distances from the head formations 358, 758.

The operating arm 450 has a mounting hole 452 that is sized to receive the central region 356 in a slip fit that will permit the operating arm 450 to pivot smoothly relative to the mounting post 350 between the "primary" position of the operating arm 450 which is depicted in FIG. 7 and the "secondary" position of the operating arm 450 which is depicted in FIG. 9. The operating arm 450 is mounted on the mounting post 350 at a location between the head formation 358 and the end 362 of the sleeve 360, with the central region 356 extending through the mounting hole 452.

In similar fashion, the universal connection plate 700 has a mounting hole 702 that is sized to receive the central region 756 in a slip fit (that will permit the plate 700 to pivot smoothly relative to the mounting post 750 between the "first" position of the plate 700 which is depicted in FIG. 7 and the second position of the plate 700 which is depicted in FIG. 9). The universal connection plate 700 is mounted on the mounting post 750 at a location between the head formation 758 and the end 762 of the sleeve 760, with the central region 756 extending through the mounting hole 702.

Referring still to FIGS. 13 and 14, a torsion coil spring 380 has coils 382 located between opposite ends 384, 386. The coils 382 extend about the sleeve 360 to mount the spring 380 on the mounting post 350 at a location between the flat wall 312 of the mounting bracket 310 and the operating arm 450. Referring to FIGS. 7 and 9, the spring end 384 extends away from the mounting post 350 to engage sleeve 760 that is carried on the mounting post 750, while the spring end 386 engages the operating arm 450 to bias the operating arm 450 (in a clockwise direction as viewed in FIGS. 7 and 9 away from the "secondary" position of the operating arm 450 depicted in FIG. 9 toward the "primary" position of the operating arm 450 depicted in FIG. 7).

Referring to FIGS. 13, 14, 25 and 26, the universal connection plate 700 has something of a W-shaped configuration that features four corner regions 9706, 9707, 9708, 8709 that define four outboard connection holes 706, 707, 708, 709, and a pointed region 9701 that defines a hole 701. The connection plate 700 also defines four inboard connection holes 716, 717, 718, 719 that are located slightly nearer the pin or mounting post 750 that mounts the connection plate 700 for pivotal movement about a pivot axis 703 (see FIG. 25) that is defined as the central axis of the pin or mounting post 750. As will be seen, the holes 706, 716 are on opposite sides of the pivot axis 703 from the holes 707, 717; and the holes 708, 718 are on substantially opposite sides of the pivot axis 703 from the holes 709, 719. Inasmuch as the holes 706, 707, 708, 709, 716, 717, 718, 719 constitute what can be referred to as "connection formations" that define what can be referred to as "connection points" for the links 800, 5800, each of the reference numerals 706, 707, 708, 709, 716, 717, 718, 719 properly refers not only to a "hole" but also to a "connection formation" and to a "connection point."

The link connection holes 706, 707, 708, 709, 716, 717, 718, 719 provide a variety of connection formations or connection points to which links (such as the links 800, 3800, 5800) can be connected to enable the operating mechanisms 100, 3100, 5100 to operate a variety of latches arranged at a variety of locations that are remote to the location of the operating mechanism.

A connecting pin 784 extends through aligned holes 451, 701 of the operating arm 450 and the universal connection plate 700 to provide a "means" for establishing a pivotal connection between the operating arm 450 and the connection plate 700. The hole 701 is slightly enlarged to permit relative movement to take place between the operating arm 450 and the connection plate 700 (i.e., if neither of the holes 451, 701 were enlarged, a pin extending therethrough in a slip fit would prevent desired relative rotation between the operating arm 450 and the connection plate 700 from taking place).

The handle tab projection 250 which extends through the backwall opening 230 and through the mounting bracket opening 330 to engage the operating arm 450, and the coupling of the operating arm 450 by the pin 784 to the connection plate 700 constitute what can be referred to as a "means" for drivingly interconnecting the handle 240 and the connection plate 700 for pivoting the connection plate 700 about a pivot axis 703 (which extends centrally through the mounting post 750) between the non-operated orientation of the connection plate (shown in FIGS. 7 and 25) and the operated orientation of the connection plate (shown in FIG. 9 and in solid lines in FIG. 26) in response to movement of the handle 240 from the non-operated position of the handle (shown in FIGS. 5, 8 and 11) to the operated position of the handle (shown in FIG. 10).

A pair of connecting pins 785 (see FIGS. 2 and 4) carried by inner end regions of the elongate links 800 extend through the link connection lines 706, 707 of tile connection plate 700 to pivotally couple the connection plate 700 to the elongate links 800. An alternate form of link-to-connection plate coupling is depicted in FIGS. 22 and 23 wherein inner end regions of the elongate links 3800 and 5800 have hook shaped end regions 3875 and 5875 that extend into the link connection holes 3717 and 5708, 5709 of the universal connecting plates 3700 and 5700, respectively.

Because the universal connection plate 700 is pivotally connected to the operating arm 450 by the connecting pin 784, and because the elongate links 800 are pivotally connected to the T-shaped lever-type link 700 by the connecting pins 785, the action of the torsion coil spring 380 in biasing the operating arm 450 (in a clockwise direction as viewed in FIGS. 7 and 9 away from the "secondary" position of the operating arm 450 depicted in FIG. 9 toward the "primary" position of the operating arm 450 depicted in FIG. 7) also causes the universal connection plate 700 to be biased (in a counterclockwise direction as viewed in FIGS. 7 and 9 away from the "second" position of the plate 700 depicted in FIG. 9 toward the "first" position of the plate 700 depicted in FIG. 7), and also causes the elongate links 800 to be biased in opposed directions (away from each other, in directions indicated by arrows 810 in FIGS. 1–4).

However, when the operating arm 450 is pivoted about its mounting post 350 in a counterclockwise direction (as viewed in FIGS. 7 and 9 away from the "primary" position of the operating arm 450 depicted in FIG. 7 toward the "secondary" position of the operating arm 450 depicted in FIG. 9), the pivotal interconnection of tile operating arm 450 with the universal connection plate 700, and the pivotal interconnection of the plate 700 with the elongate links 800 causes the plate 700 to pivot about its mounting post 750 (in a clockwise direction as viewed in FIGS. 7 and 9 away from the "first" position of the plate 700 depicted in FIG. 7 toward tile "second" position of the plate 700 depicted in FIG. 9), and also causes the elongate links 800 to execute "unlatching" movements (toward each other, in directions indicated by arrows 820 in FIGS. 1–4).

Referring again to FIGS. 13 and 14, the operating arm 450 has a rather complex configuration that includes a substantially flat, elongate central region 454 (through which the mounting hole 452 is formed) that extends between one end where a U-shaped formation 460 is provided, and an opposite end 470, through which the hole 451 is formed.

The U-shaped formation 460 is defined by first and second forwardly-rearwardly extending legs 462, 464 that are interconnected near their forward ends by a base leg 465. Tile U-shaped formation 460 serves the dual functions 1) of providing the leg 462 to be engaged by the rearwardly projecting formation 250 of the handle 210 (so that the operating arm 450 will be moved by the rearwardly projection formation 250 when the handle 240 pivots about its mounting pin 280), and 2) of providing the leg 464 to be selectively engaged and disengaged by a cam 520 of the lock mechanism 500 (to "lock" and "unlock" the operating mechanism 100 in response to operation by the key 510 of the lock assembly 500).

The operating mechanism 100 can, of course, be used with a wide variety of commercially available latch assemblies—for example the latch assemblies 1100 that are sold by the Eberhard Manufacturing Co. division of The Eastern Company, Strongsville, Ohio 44136 under the product designations 4974-52. Referring to FIG. 15, the latch assembly 1100 has a welded casing 1120 that houses portions of the latch bolt 1110 together with a compression coil spring 1130 that biases the latch bolt 1110 toward an extended position that is depicted in FIGS. 1, 2 and 15 wherein the latch bolt 1110 engages a conventional strike 1150 that is carried by the door frame portions 22. When the link 800 is moved in the direction of the arrow 820 to retract the latch bolt 1110, the latch bolt 1110 disengages the strike 1150, as will be readily understood by those who are skilled in the art.

Figure 16:
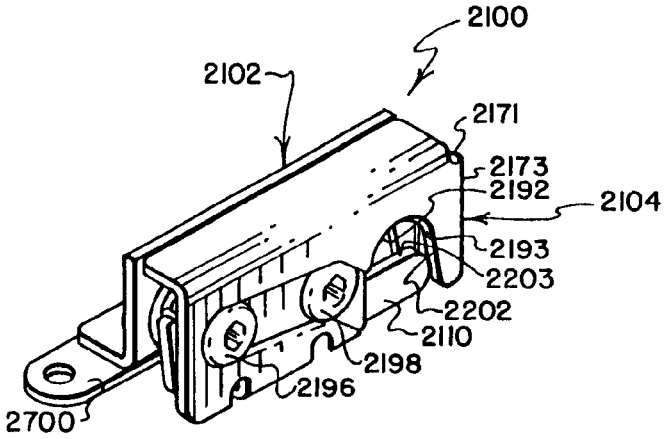
FIGS. 16 and 17 are perspective views taken from different directions of one of the rotary latch assemblies utilized in the plural-point latch system depicted in FIGS. 3 and 4.
Figure 17:
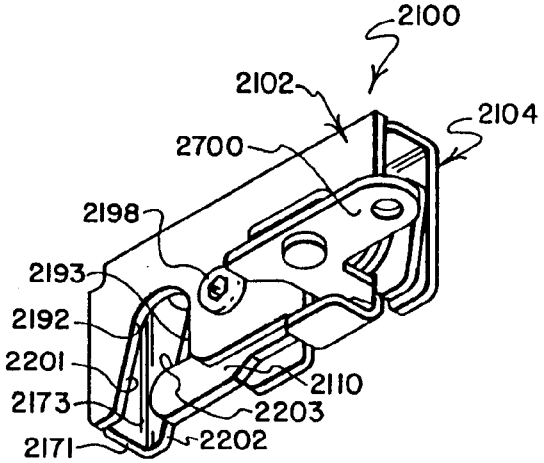
Figure 18:
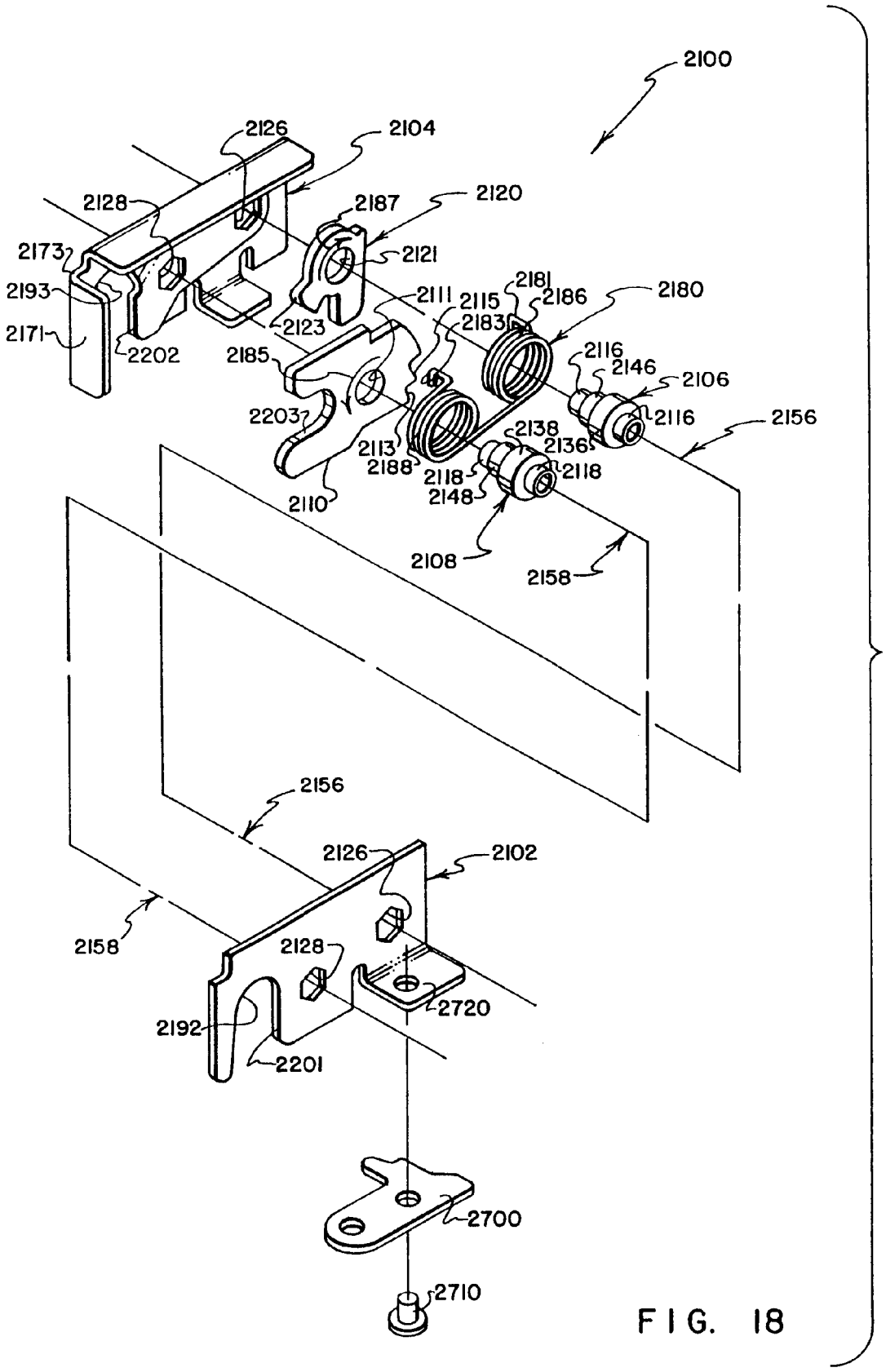
FIG. 18 is an exploded perspective view showing components of one of the rotary latch assemblies utilized in the plural-point latch system depicted in FIGS. 3 and 4.
Figure 19:
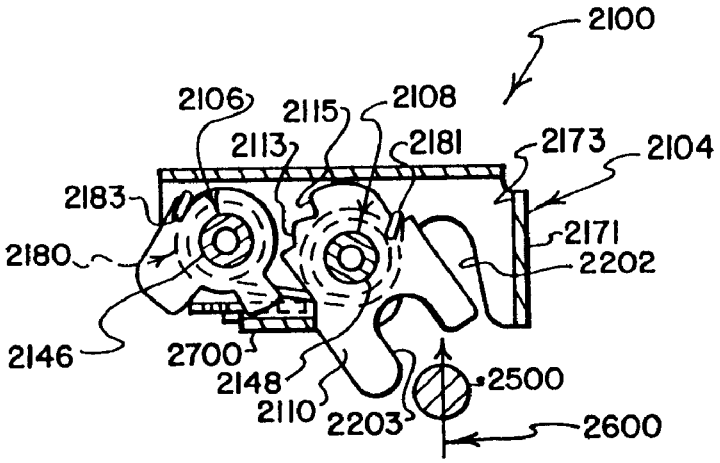
FIGS. 19, 20 and 21 are sectional views, on an enlarged scale, as seen from a plane indicated by a line A—A in FIG. 4, and depicting somewhat schematically a sequence of three steps by which a suitably configured strike is received by one of the rotary latches of the second embodiment, with FIG. 19 showing the latch "unlatched" and the strike not yet engaging the latch, with FIG. 20 showing the strike being received by the latch and showing a preliminary latching orientation of latch components, and with FIG. 21 showing a fully latched configuration of the strike and latch components.
Figure 20:
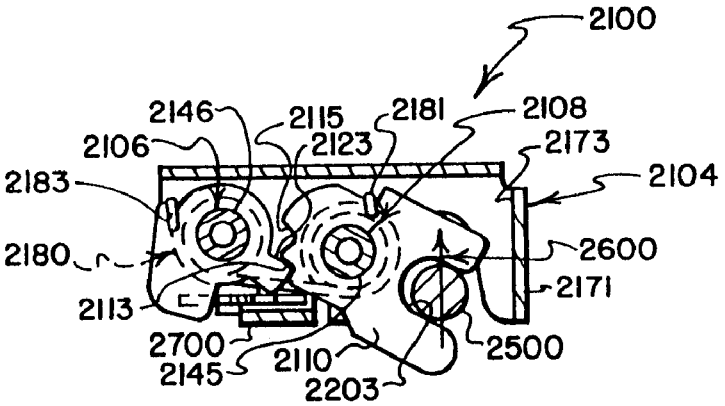
Figure 21:
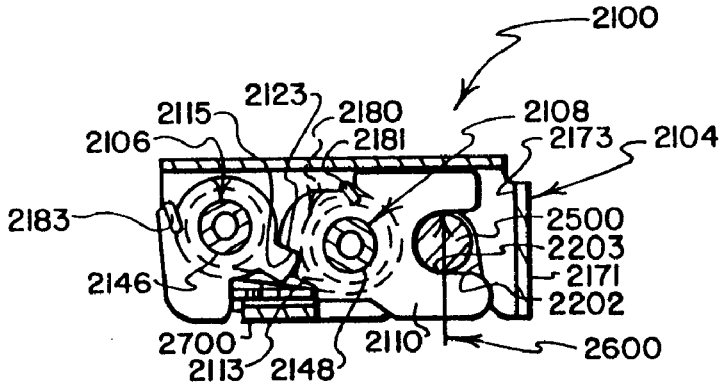

If the operating mechanism 100 is to be used with a pair of rotary latches, the rotary latches preferably are of a type that incorporate features of the inventions of the referenced Paddle Handle Operating Mechanism Patents—such as the rotary latches 2100 that are depicted in FIGS. 16–18. FIGS. 19–21 also are provided to schematically illustrate how a typical one of the latches 2100 performs during three stages that occur as a suitably configured strike formation 2500.

A "suitably configured strike formation" 2500 for use with one of the rotary latches 2100 (referred to hereinafter simply as a "strike 2500") typically is a generally cylindrical part of a metal member (not shown) that is suitably attached to structure such as the door frame 22 and located so as to be engaged by and received in one of the latches 2100 (when the closure 20 is closed) in a manner that will be described shortly, so that the strike 2500 is releasably retained by the rotary latch assembly 2100.

Referring to FIG. 18, each of the rotary latch assemblies 2100 has what will be referred to as a "housing" that consists of opposed first and second "housing side plates" 2102, 2104. The side plates 2102, 2104 are held in spaced, parallel relationship by first and second spacers or bushings 2106, 2108.

The first and second bushings 2106, 2108 are tubular (i.e., they have hollow interiors), and have reduced diameter end regions 2116, 2118 that are sized to be received in a slip fit within hex-shaped holes 2126, 2128 that are formed in the side plates 2102, 2104, respectively. To securely retain the hollow, reduced diameter end regions 2116, 2118 in the hex-shaped holes 2126, 2128 (to thereby rigidly interconnect the housing side plates 2102, 2104), the end regions 2116, 2118 are deformed and enlarged to form heads 2196, 2198 (see FIGS. 16 and 17) that have hollow interiors that tend to be of slightly hex shape after the end regions 2116, 2118 have been properly deformed to fully engage the sides of the hex-shaped holes 2126, 2128. Because the holes 2126, 2128 are hex-shaped, and because the hollow end regions 2116, 2118 are expanded (during formation of the heads 2196, 2198) to fully fill the hex-shaped holes 2126, 2128, good, secure, rotation-resistant connections are formed that rigidly interconnect the side plates 2102, 2104 and that resist loosening and rotation of the bushings 2106, 2108 relative to the side plates 2102, 2104.

Referring still to FIG. 18, the bushings 2106, 2108 are generally cylindrical, and provide stepped central regions that have relatively large diameter portions 2136, 2138 and relatively medium diameter portions 2146, 2148, respectively. The end and central regions 2116, 2136, 2146 of the bushing 2106 are concentric about a first transversely extending axis that is designated by the numeral 2156. The end and central regions 2118, 2138, 2148 of the bushing 2108 are concentric about a second transversely extending axis that is designated by the numeral 2158. Optional internal threads (not shown) may be formed within hollow interiors of the bushings 2106, 2108 to permit threaded fasteners of suitable size (not shown) to be connected to the rotary latch assemblies 2100 (should this be desirable, for example as an aid in mounting the latch assemblies 2100 on the closure 20).

The side plates 2102, 2104 define aligned first and second U-shaped notches 2201, 2202, respectively, that are oriented so that, as the closure 20 (on which the rotary latch assemblies 2100 are mounted) is moved toward its closed position, the resulting relative movement of a separate one of the strikes 2500 toward each of the latch assemblies 2100 (in the direction indicated by arrows 2600 in FIGS. 19–21) will cause each of the generally cylindrical strikes 2500 to be received in the first and second U-shaped notches 2201, 2202 of a separate one of the latch assemblies 2100. As one of the strikes 2500 enters the first and second U-shaped notches 2201, 2202, it also is received in a third U-shaped notch 2203 defined by the rotary jaw 2110 of the latch assembly 2100—and the third U-shaped notch 2203 functions in concert with the first and second U-shaped notches 2201, 2202 to receive and latchingly retain the strike 2500 in the notches 2201, 2202, 2203 when the closure 20 is closed.

Utilization preferably is made of the second U-shaped notch 2202 (either alone or in concert with the first U-shaped notch 2201) to define a strike engagement surface (or surfaces) that is (are) directly engageable by the strike 2500. If the first and second U-shaped notches 2201, 2202 are identically configured and positioned to extend in congruent alignment, a pair of congruently aligned strike engagement surfaces 2192, 2193 (see FIG. 17) are defined by the notches 2201, 2202—which are engageable by the strike 2500 as the strike 2500 moves into and is latchingly retained within the U-shaped notches 2201, 2202. If, on the other hand, the first U-shaped notch 2201 is configured such that it is wider than the second U-shaped notch 2202 (so that the surfaces that define the first notch 2201 are positioned such that they cannot physically engage the strike 2500), the only strike engagement surface that will be defined by either of the notches 2201, 2202 is the strike engagement surface 2193 that is defined by the second U-shaped notch 2202.

By always ensuring that the strike engagement surface 2193 is defined by the second U-shaped notch 2202 (regardless of whether an additional strike engagement surface 2192 is defined by the first U-shaped notch 2201), advantage will always be taken of the close proximity presence to the second notch 2202 (and to the strike engagement surface 2193) of a transversely extending reinforcing flange 2171 that is formed integrally with the second side plate 2104 near one end thereof. A tight radius bend 2173 connects the flange to a narrow portion 2175 (see FIGS. 1 and 2) of the second side plate 2104 that extends along one side of the second notch 2202 (and that defines the strike engagement surface 2193). The close proximity presence of the transversely extending flange 2171 and the bend 2173 to the second notch 2202 (and to the strike engaging surface 2193 that is defined by the second notch 2202) strengthens and rigidifies the second housing side plate 2104 in the critical area adjacent the strike engaging surface 2193.

While the second U-shaped notch 2202 could be configured such that it is wider than the first U-shaped notch 2201 (whereby the only strike engagement surface that would be defined by either of the notches 2201, 2202 is the strike engagement surface 2192 that is defined by the first U-shaped notch 2101), this option does not conform to preferred practice unless the first side plate 2102 is provided with a transversely extending flange (not shown) that is substantially identical to the depicted flange 2171, but which extends from the first side plate 2102 toward the second side plate 2104 to bridge the space therebetween (instead of extending from the second side plate 2204 toward the first side plate 2102 to bridge the space therebetween, as does the depicted flange 2171).

Referring to FIG. 18, housed between the side plates 2102, 2104 are the rotary jaw 2110 and the rotary pawl 2120. The rotary jaw 2110 has a mounting hole 2111 that receives the bushing diameter 2148 therein in a slip fit to mount the rotary jaw 2110 on the bushing 2108 for limited angular movement about the transversely extending axis 2158. The rotary pawl 2120 has a mounting hole 2121 that receives the bushing diameter 2146 therein in a slip fit to mount the rotary pawl 2120 on the bushing 2106 for limited angular movement about the transversely extending axis 2156.

Also housed between the side plates 2102, 2104 is a torsion coil spring 2180 that has a first coil 2186 that extends about the diameter 2136 of the bushing 2106, and a second coil 2188 that extends about the diameter 2138 of the bushing 2108. An end 2181 of the spring 2180 engages the rotary jaw 2110 for biasing the rotary jaw 2110 in a direction of angular movement about the axis 2158 that is indicated by an arrow 2185. An opposite end 2183 of the spring 2180 engages the rotary pawl 2120 for biasing the rotary pawl 2120 in a direction of angular movement about the axis 2156 that is indicated by an arrow 2187.

Referring to FIGS. 18–20, the rotary jaw 2110 and the rotary pawl 2120 are provided with engageable formations 2113, 2123, respectively, that cooperate to "preliminarily latch" the rotary jaw 2110 in engagement with the strike 2500 (see FIG. 20) after the strike 2500 has moved only a short distance into the aligned first and second U-shaped notches 2201, 2202 during movement of the closure 20 toward its closed position.

Referring to FIG. 21, the rotary jaw 2110 and the rotary pawl 2120 also are provided with engageable formations 2115, 2123, respectively, that cooperate to "fully latch" the rotary jaw 2110 in engagement with the central region 56 of the strike 2500 after the strike 2500 has moved as far as it is going to move into the aligned first and second U-shaped notches 2201, 2202 as the closure 20 is moved to its fully closed position. When the engageable formations 2115, 2123 are engaged (as is depicted in FIG. 21), the rotary jaw 2110 is prevented by the rotary pawl 2120 from executing unlatching movement until the rotary pawl 2120 is rotated about the axis 2156 to a pawl-releasing position wherein the engageable formations 2115, 2123 disengage to permit the rotary jaw 2110 to rotate away from its fully latched position toward its unlatched position wherein the strike 2500 is free to move out of the third U-shaped notch 2203 that is defined by the rotary jaw 2110. This type of pawl-controlled jaw latching action is well known to those who are skilled in the art, and is further illustrated and described in a number of the patents that are identified above.

To move the rotary pawl 2120 in opposition to the action of the torsion coil spring 2180 (i.e., in a direction opposite the arrow 2187) from a pawl-retaining position (depicted in FIG. 21) to a pawl-releasing position (depicted in FIG. 19), a release lever 2700 is pivotally mounted by a rivet 2710 (see FIG. 18) on a right-angle projection 2720 of the housing side plate 2102—which is effected by movement of an associated one of the links 800 (each of the links 800 connects with the release lever 2700 of a separate one of the rotary latch assemblies 2100).

Movement of the links 800 in the direction of the arrows 820 to effect "unlatching" of the rotary latch assemblies 2100 takes place in response to movement of the handle 240 from its normal non-operated position shown in FIGS. 5 and 8 to its operated position shown in FIG. 10. When the operated handle 240 is released, it returns to its non-operated position under the influence of the spring 290, hence the rearward extending projection 250 no longer remains in the "second" position of FIG. 10 where it holds the operating arm 450 in its "secondary" position of FIG. 9. As the projection 250 returns to the "first" position of FIGS. 5 and 8, the operating arm 450 is caused to return to its "primary" position of FIG. 7 due to the biasing action of the spring 380, hence the links 800 return to their normal positions of FIGS. 2 and 3 (due at least in part to the biasing action of the operating arm spring 380) whereby the rotary latches 2100 are ready to be slammed into latching engagement with strikes 2500.

So long as the rotary jaw 2110 of the rotary latch assembly 2100 in its unlatched position (depicted in FIG. 19), the rotary jaw 2110 always can be slammed into latching engagement with the strike 2500. This is true regardless of how the relatively movable components of the operating mechanism 100 may be positioned. As the rotary jaw 2110 receives the strike 2500 within its U-shaped notch 2203, and as the strike 2500 moves into the aligned first and second U-shaped notches 2201, 2202 of the housing side plates 2102, 2104, the strike 2500 becomes cooperatively confined by the combined action of the first, second and third notches 2201, 2202, 2203. When the strike 2500 reaches the position that is depicted in FIG. 20, the rotary pawl 2120 and the rotary jaw 2110 become "preliminarily latched" (i.e., the engagement formations 2113, 2123 engage to prevent unlocking of the rotary jaw 2110). When the strike 2500 reaches the fully latched position depicted in FIG. 21, the engagement formations 2115, 2123 engage to fully lock the closure 20 in its closed position.

Referring to FIGS. 11 and 12, to securely connect the "handle and housing assembly" or "front module" 200 to the "bracket, latch and linkage assembly" or "rear module" 300 (so that the assemblies 200, 300 will be securely retained in place on the closure 20) , threaded studs 969 are provided that project rearwardly from the back wall 212 of the pan-shaped housing 210 through openings 979 that are formed through the flat wall 312 of the mounting bracket 310, and lock nuts 989 are threaded onto the studs 969 and tightened in place so that the gasket set 120 that extends about the mounting opening 34 is compressed to form a weather tight seal as the front and rear assemblies are securely connected by the fasteners 969, 989. By this arrangement, the assemblies 200, 300 are quickly, easily and yet securely connected and fastened in place on the closure, with proper alignment and registry of the assemblies 200, 300 being ensured. To provide access to one of the sets of fasteners. 969, 989, a relatively large diameter access hole 704 is formed through the connection plate 700.

Referring to FIGS. 11 and 12, the key-operated cam lock assembly 500 is a commercially purchased assembly available from a wide variety of sources, and is selected to provide a quarter-turn for the cam 520, with the key 510 (see, for example, FIGS. 8 and 10) preferably being removable in both the "locked" position of the cam 520 (depicted in FIG. 7) and the "unlocked" position of the cam 520 (depicted in FIG. 9). Referring to FIG. 12, the assembly 500 has a housing 530 with threaded exterior portions 532, and with opposed flat surfaces 539 (only one of which is shown in FIG. 12) that engage the flats 239 of the lock mount opening 238 to prevent the housing 530 from rotating relative to the pan-shaped housing 210. A nut 540 is threaded onto the threaded exterior portions 532 of the body 530 to hold the lock assembly 500 in place on the pan-shaped housing 210.

So long as the key-locking assembly 500 positions the cam 520 in its "unlocked" position, as is depicted in FIG. 9, pivotal movement of the operating arm will not be impeded by the cam 520—hence, the operating handle 240 can be pivoted out of its nested, non-operated position (shown in FIG. 8) to its extended, operated position (shown in FIG. 10) to cause the tab 250 to pivot the operating arm to pivot the rotary pawl 420 away from its normal jaw-retaining position (shown in FIG. 21) toward its jaw-releasing position (shown in FIG. 19) to release the pawl formation 2123 from-engaging either of the jaw formations 2113, 2115, whereupon the rotary jaw 2120 pivots under the influence of the spring 2180 away from its latched position (shown in FIG. 21) to its unlatched position (shown in FIG. 19) to release the strike 2500.

Figure 25:
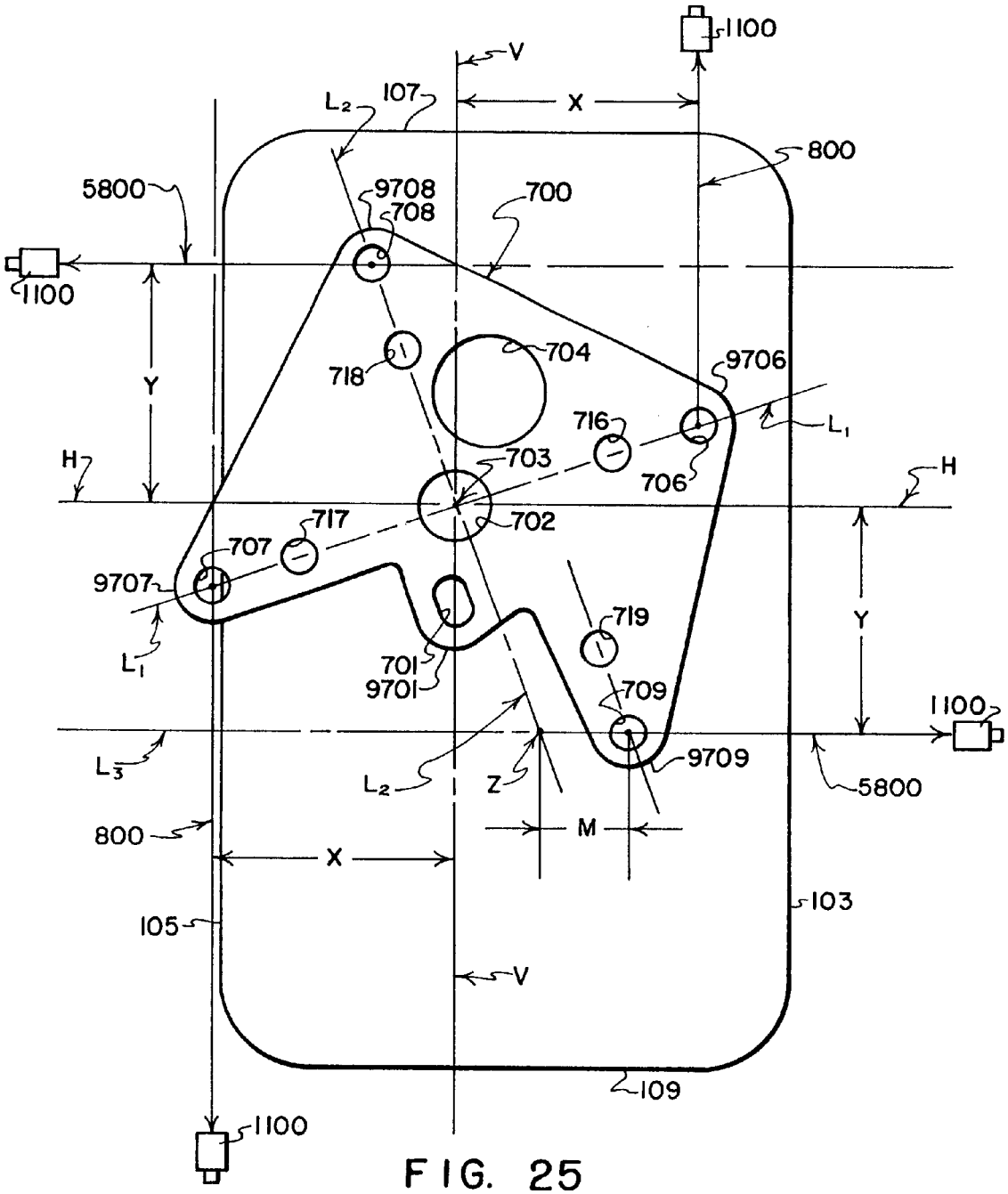
FIG. 25 is rear side elevational view of selected components of the paddle handle operating mechanisms shown in FIG. 7, with the universal connection plate in its non-operated orientation, and with arrows schematically showing how oppositely directed pairs of links may be coupled to the connection plate to achieve concurrent link movements (measured along the lengths of the links) of substantially equidistant magnitudes.
Figure 26:
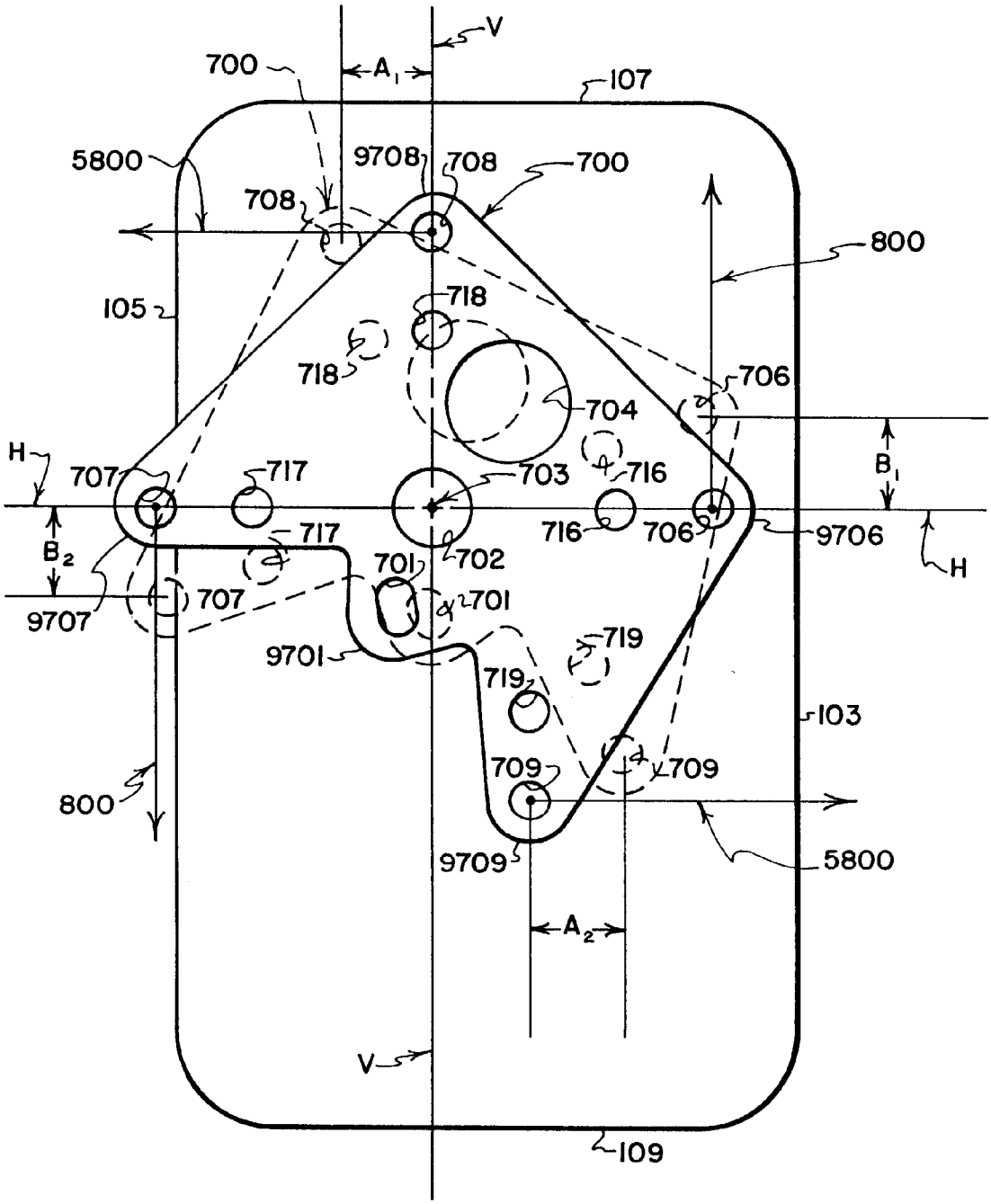
FIG. 26 is a rear side elevational view similar to FIG. 25, but with the universal connection plate pivoted to its operated orientation.
Figure 27:
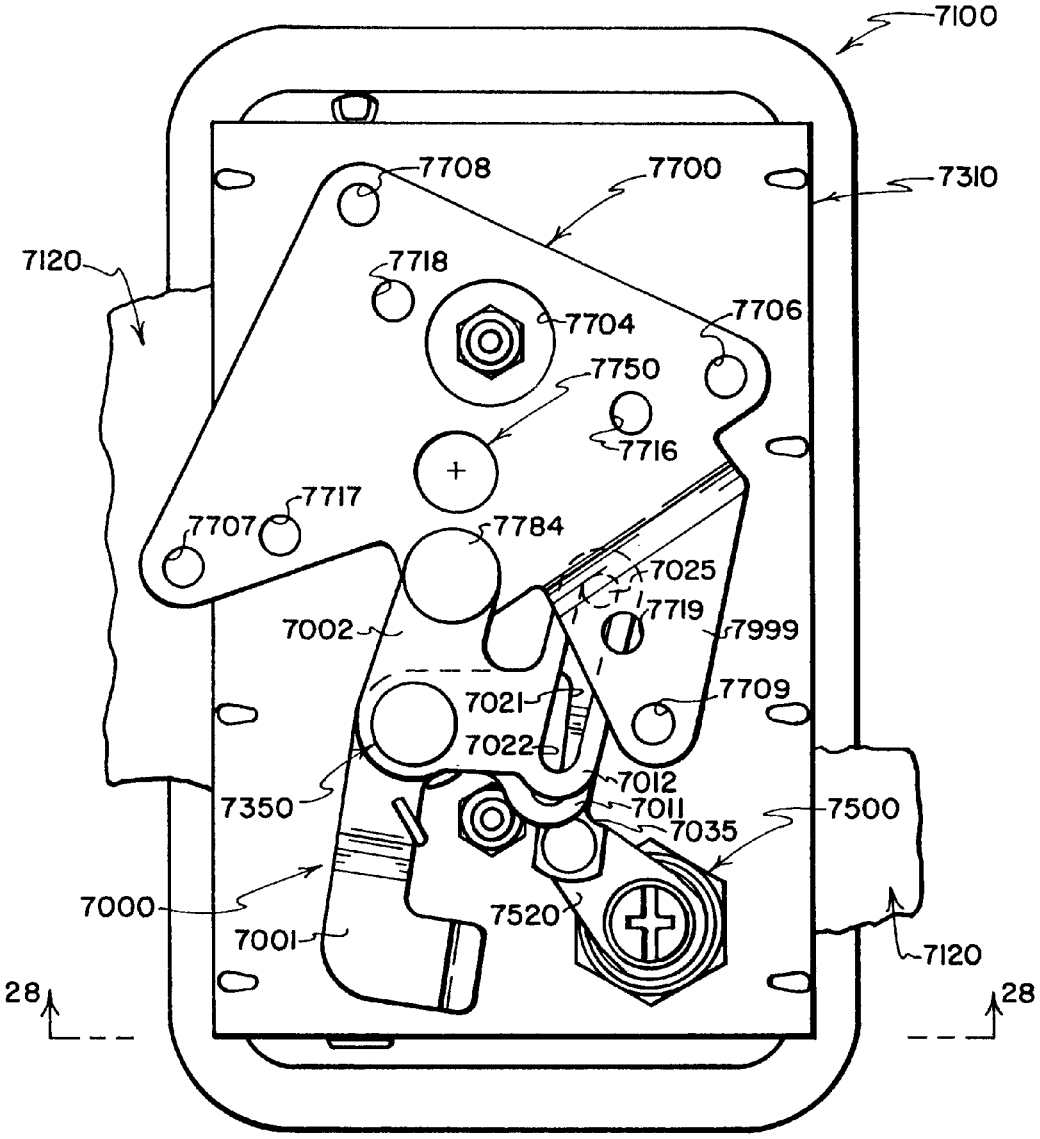
FIG. 27 is a bottom plan view of another paddle handle operating mechanism similar to that shown in FIG. 24 but carrying a modified form of connection plate that has one of its four connection regions extending out of the plane or the other three connection regions to illustrate how the connection plate may be modified to accommodate the presence of other operating components (such as a disconnect linkage) without undesirably affecting the operation of and the versatility provided by the universal connection plate, with the relatively movable components positioned as is depicted in FIG. 24 except that the cam of the key operated lock assembly is in its locked position.
Figure 28:
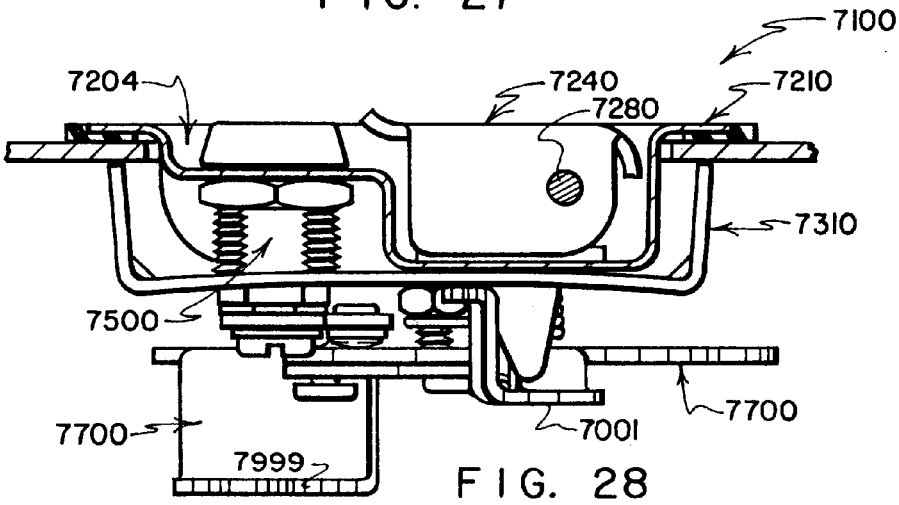
FIG. 28 is a sectional view as seen from a plane indicated by a line 28—28 in FIG. 27.
Figure 29:
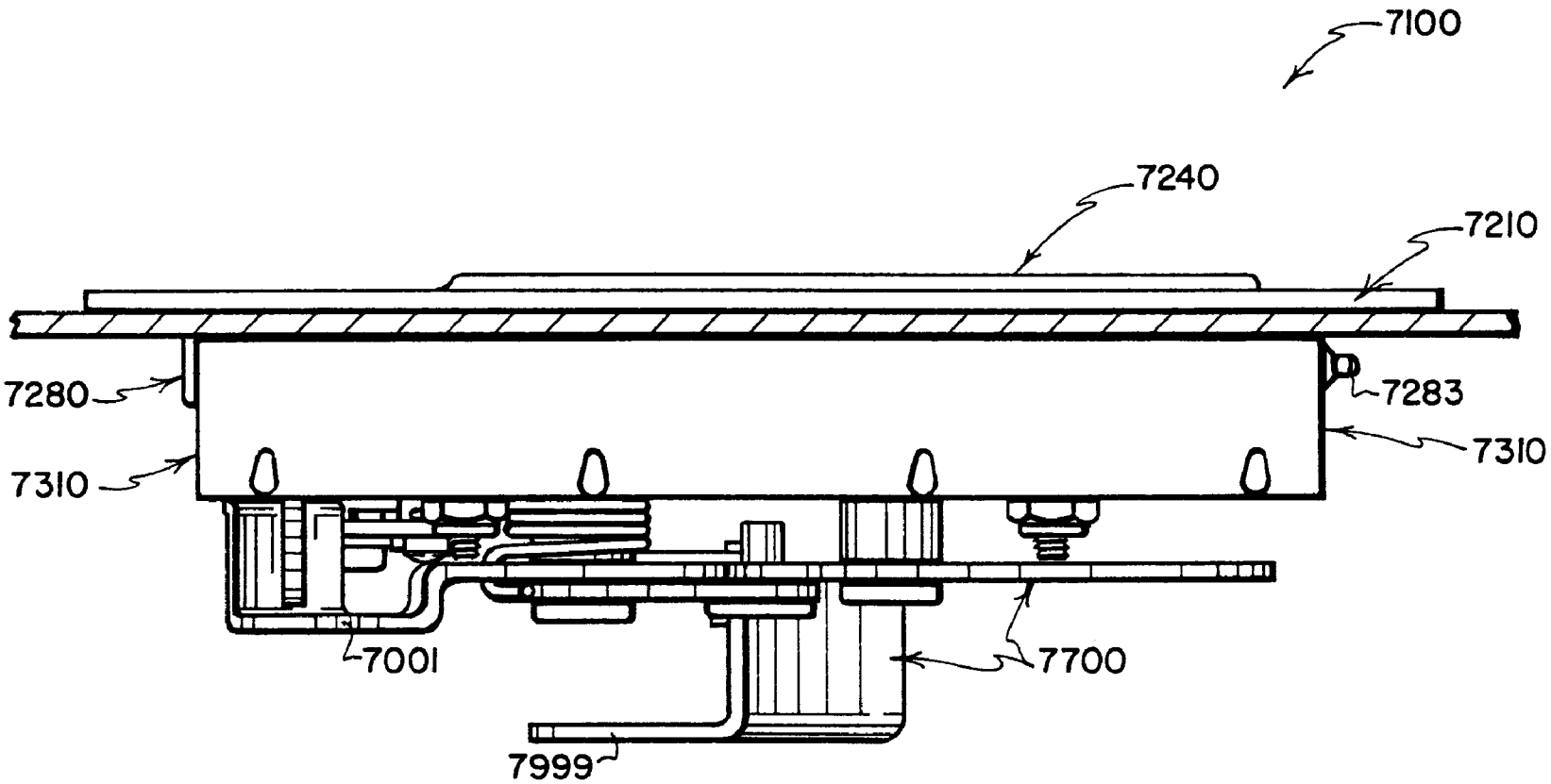
FIG. 29 is a side elevational view thereof.
Figure 30:
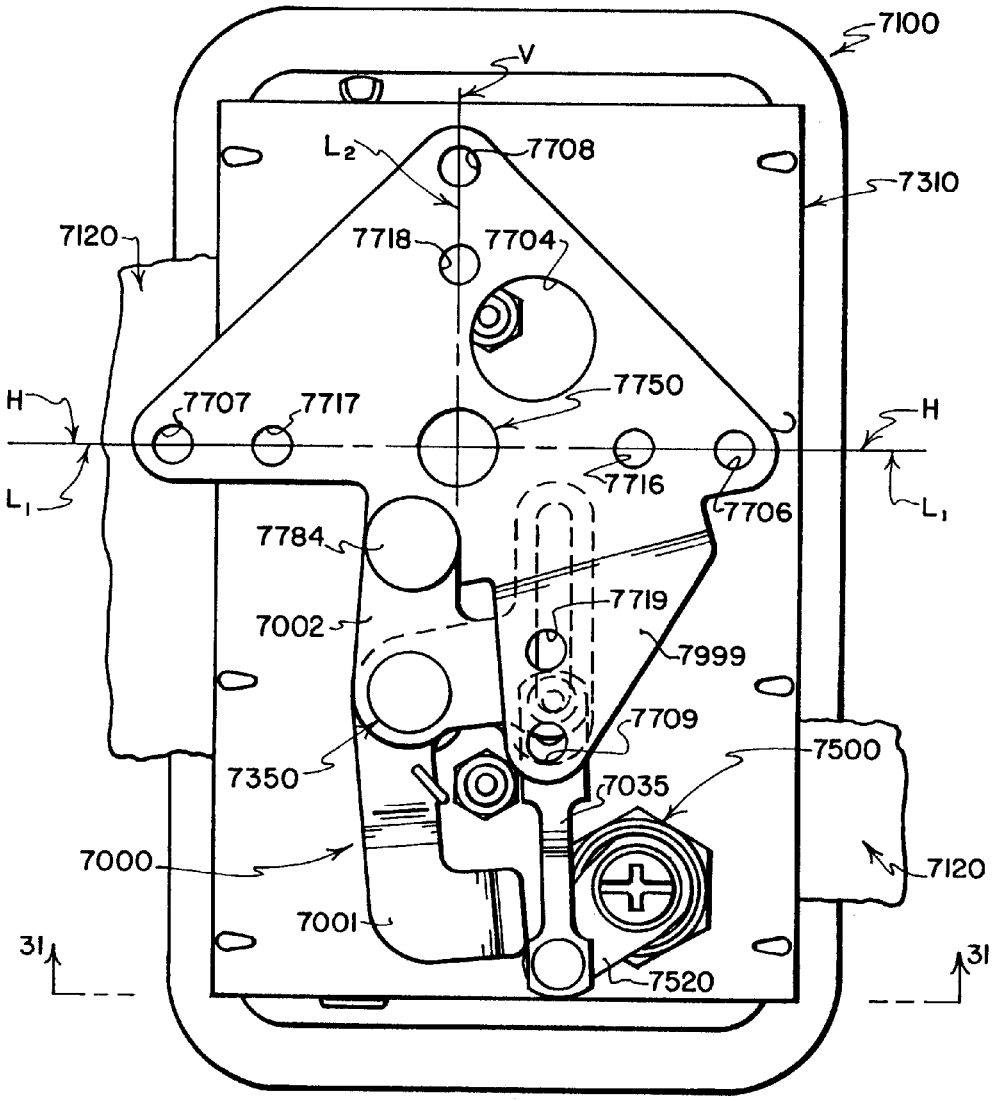
FIG. 30 is a bottom plan view similar to FIG. 27 but with the cam of the lock assembly in its unlocked position, and with an operating handle of the operating mechanism in an operated position that causes link elements of an operating arm to pivot the universal mounting plate to move any latch operating links that may be connected thereto.
Figure 31:
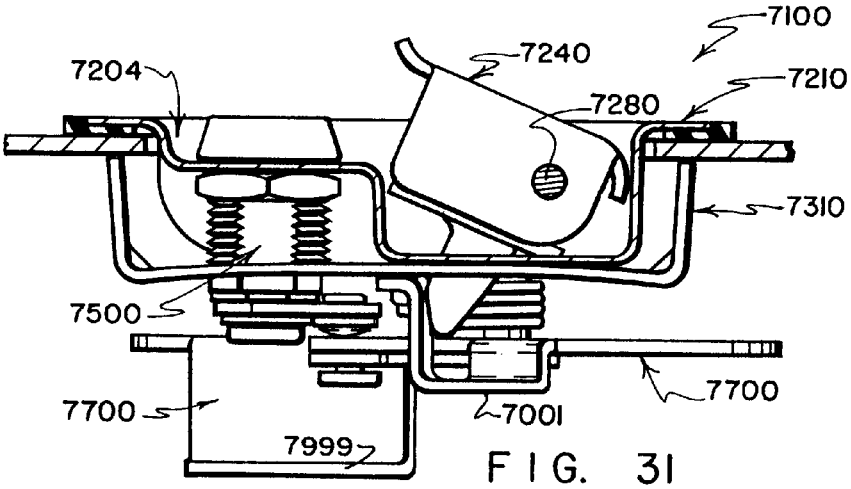
FIG. 31 is a sectional view as seen from a plane indicated by a line 31—31 in FIG. 30; and, FIG. 32 is a side elevational view thereof.
Figure 32:
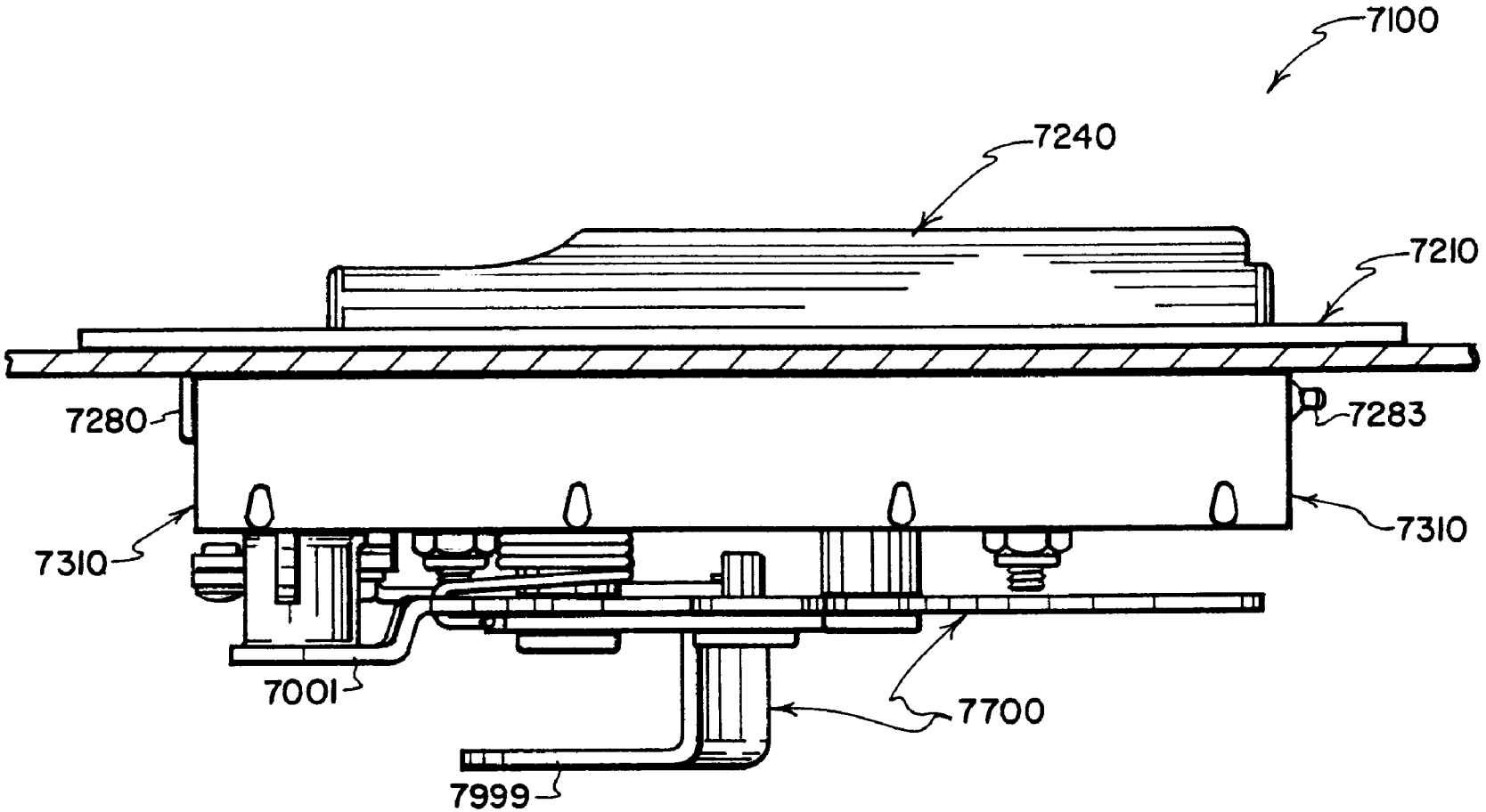

The key-operated lock cylinder assembly 500, also referred to herein as a key-operated cam lock assembly, constitutes both 1) a "means" for being connected to the housing 210 and for selectively preventing and permitting pivotal movement of the connection plate 700 from the non-operated orientation shown in FIGS. 7 and 25 to the operated orientation shown in FIGS. 9 and 26, and 2) a "means" for being connected to the housing 210 and for selectively preventing and permitting movement of the handle 240 from the non-operated position shown in FIGS. 5, 8 and 11 to the operated position shown in FIG. 10.

The non-locking paddle handle operating mechanism embodiments 3100, 5100 which are shown in FIGS. 22 and 23, respectively, employ no key-locking assemblies 500. Therefore, the paddle handles of these embodiments always may be operated to unlatch such latches as are connected thereto by such suitable links as the links 3800, 5800.

Figure 24:
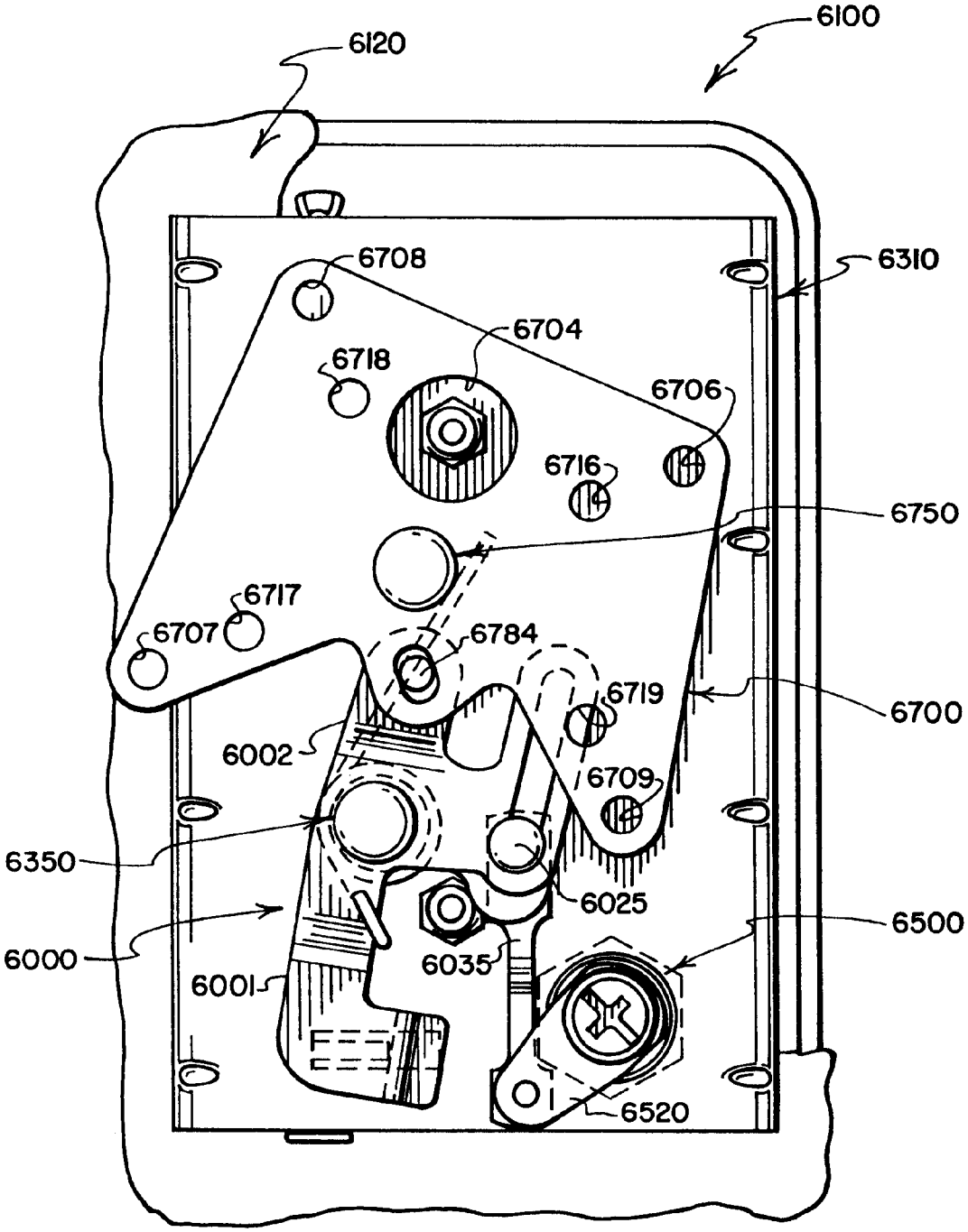
FIG. 24 is a rear side elevational view of a locking paddle handle operating mechanism that embodies features of the present invention and includes a handle disconnect linkage of the type that is depicted in FIGS. 14–31 of the First and Second Disconnect Cases, with relatively movable components of the mechanism positioned as depicted in FIG. 7 except that a cam of the key-operated lock cylinder assembly is in its unlocked position.

Referring to FIG. 24, the lockable paddle handle operating mechanism 6100 that is shown here is identical to the lockable paddle handle operating mechanism 100 that is depicted in FIG. 7 except that the operating arm 450 of the-mechanism 100 has been replaced with a linkage 6000 that provides what is known in the art as a "handle disconnect" feature. To avoid the need to repeat portions of the description of components of the mechanism 100 that have identical counterparts in the mechanism 6100, "corresponding reference numerals" are used in FIG. 24 to designate components of the operating mechanism 6100 (the numerals are larger by a magnitude of six thousand) than "corresponding reference numerals" that are used in FIG. 7 to designate identical components of the operating mechanism 100.

In the handle-disconnect locking embodiment of operating mechanism 6100 that is shown in FIG. 24, the linkage 6000 (which replaces the operating arm 450 of the operating mechanism 100 depicted in FIG. 7) includes two elements 6001, 6002 that either pivot in unison about the axis of a support post 6350 to drivingly connect a paddle-type operating handle (not shown) of the mechanism 6100 to the connection plate 6700, or that fail to pivot in unison so that handle movement will not cause corresponding movement of the connection plate 6700 when the mechanism 6100 is locked by a key-operated lock cylinder assembly 6500. What the components of the linkage 6000 do is to provide a "disconnect" that permits free-wheeling pivotal movement of the handle (not shown) of the operating mechanism 6100 when the operating mechanism 6100 is "locked"—so that the operating mechanism 6100 cannot be forced open when locked by prying its operating handle to it operated position.

The various components that comprise the disconnect linkage 6000 are depicted and described in detail in conjunction with FIGS. 14–31 of the First and Second Disconnect Cases, the disclosures of which are incorporated herein by reference. By utilizing the disconnect linkage 6000 together with the universal connection plate 6700, a more tamper resistant, lockable operating mechanism (than the lockable operating mechanism 100 described earlier herein) is provided that can be connected easily with a variety of kinds of latch operating links for unlatching a plurality of commercially available, remotely located latches.

The components that comprise the linkage 6000 are identical to components that comprise a disconnect linkage 7000 of an alternate form of paddle handle operating mechanism 7100 that is well illustrated in FIGS. 27–32; therefore, a better understanding of the components of the linkage 6000 will be gained from the description that follows of the components of the linkage 7000.

Referring to FIGS. 27–32, the lockable paddle handle operating mechanism 7100 shown here essentially differs from the lockable paddle handle operating mechanism 6100 shown in FIG. 24 in that an alternate form of connection plate 7700 is employed in place of the form of connection plate 6700 that is utilized in the embodiment shown in FIG. 24. All that is different about the connection plates 6700, 7700 is that the connection plate 6700 is flat (i.e., its various regions all extend in a single plane that substantially parallels the backwall of the pan-shaped housing of the mechanism 6100), whereas the connection plate 7700 has one corner region 7999 (it defines the link connection holes 7709, 7719) which extends in a different plane that parallels a plane containing other corner regions of the connection plate 7700 that define the link connection holes 7706, 7707, 7708, 7716, 7717, 7718.

The connection plates 6700, 7700 are, in fact, so similarly configured that, when viewed from the rear of the paddle handle operating mechanisms 6100, 7100 (see FIGS. 24 and 27), the plates 6700, 7700 have exactly the same shape, and the link connection holes that are defined by these plates are in precisely the same locations—except that the holes 7709, 7719 are located in a plane different from the plane in which the remaining link connection holes are situated. Therefore, what FIGS. 25–27 simply illustrate is that, if available space permits, portions of the connection plate used with paddle handle operating mechanisms that embody the present invention need not all reside within the same plane in order to operate substantially identically; hence, if space is available, the connection plate can take a three dimensional configuration in order to clear space that may be needed by other more position-critical components of the associated paddle handle operating mechanisms.

Inasmuch as the disconnect linkages 6000, 7000 of the paddle handle operating mechanisms 6100, 7100 are identical, and inasmuch as. these disconnect linkages are discussed in much greater detail in the referenced First and Second Disconnect Cases, only a brief description or the operation of the linkage 7000 is provided here. In essence, what the disconnect linkage 7000 does is to use two link elements 7001, 7002 that pivot about a common support pin 7350 to replace the single-piece operating arm 450 (of the mechanism embodiment 100) which pivots about the support pin 350—with the link elements 7001, 7002 having overlying portions 7011, 7012 that define overlying slots 7021, 7022 wherein a pin 7025 (depicted by broken lines in FIG. 27) moves between a connecting position (located near the bottoms of the slots 7021, 7022, for example in the location of the pin 6025 that is shown in FIG. 24) and a disconnect position (see FIG. 27) to either drivingly connect the link elements 7001, 7002 for concurrent rotation about the support pin 7350, or to disconnect the link elements 7001, 7002 such that pivoting of the link element 7001 about the support pin 7350 will not cause concurrent pivoting of the other link element 7002 about the support pin 7350.

Movement of the pin 7025 between its connecting position and its disconnect position is effected by a link 7035 that is connected to a cam 7520 of the key-operated lock assembly 7500. When the paddle handle operating mechanism 7100 is "locked" by the key-operated lock assembly 7500, the link 7035 holds the pin 7025 in the disconnect position—so that, when the handle 7240 pivots from its non-operated position (see FIG. 28) to its operated position (see FIG. 31), the resulting pivotal movement of the link element 7001 will cause no corresponding pivotal movement of the link element 7002. When the paddle handle operating mechanism 7100 is "unlocked" by the key-operated lock assembly 7500, the link 7035 moves the pin 7025 to a position in the overlying slots 7021, 7022 where the pin 7025 will drivingly connect the link elements 7001, 7002 for concurrent movement—so that, when the handle 7240 pivots from its non-operated position to its operated position, the resulting concurrent pivotal movement of the link elements 7001, 7002 will cause the connection plate 7700 to pivot from its non-operated orientation (see FIG. 27) to its operated orientation (see FIG. 30) so as to move such links as may be connected to its link connection holes and to thereby operate such latches as are connected to these links.

Referring now to FIG. 25 wherein a first set of oppositely acting links 800 is shown schematically as being connected to the link connection holes 706, 707 and a second set of oppositely acting links 5800 is shown schematically as being connected to the link connection holes 708, 709, it will be seen that each of the links 800 is spaced from a vertical centerline "V" of the pivot axis 703 by a distance "X," and that each of the links 5800 is spaced from a horizontal centerline "H" of the pivot axis 703 by a distance "Y."

The link connection holes 706, 707 conform with what is deemed to constitute "optimal layout positioning"—one reason being that they are located at equal distances from the pivot axis 703 along a common line "$L_1$" that intersects the pivot axis 703. The "$L_1$" alignment and equal-distance positioning of the holes 706, 707 ensures that the distances "X" by which the holes 706, 707 are separated from the vertical axis "V" are equal.

The link connection holes 708, 709 are located in a manner that differs from "optimal-layout positioning" in that only the connection hole 708 resides along a common line "$L_2$" that intersects the pivot axis substantially at right angles with the common line "$L_1$." If the "$L_2$" location of the connection hole 708 is selected so that the hole 708 is the same distance from the pivot axis 703 as are the holes 706, 707, then the distance "Y" by which the hole 708 is separated from the horizontal axis "H" will equal the distances "X" by which the holes 706, 707 are separated from the vertical axis "V." In the depicted layout, the holes 706, 707, 708 are, in fact, all equidistantly located from the pivot axis 703, and this corresponds with tile ideals of the "optimal layout positioning" approach of the present invention.

The reason why the link connection hole 709 is not to be located along the line "$L_2$" on the opposite side of the pivot axis 703 from the hole 708 (at an "optimal" location for the hole 709 that is indicated by the letter "Z" in FIG. 25) is because a determination has been made that locating the hole 709 at optimal point "Z" will cause a link 5800 that is coupled to the connection plate 7700 at such a location of the hole 709 to interfere with (i.e., to block or to move into during normal operation) space that needs to be used by (or reserved for movement by) other more position-critical components of the paddle handle operating mechanism on which the connection plate 7700 is mounted.

Deciding where to place the hole 709 (if the hole 709 cannot reasonably be located along the line "$L_2$" at the same distance from tile pivot axis 703 as the other holes 706, 707, 708, namely at optimal point "Z") is quite simple: a location is chosen along a line "$Y_3$" (which parallels the "H" axis at a distance "Y" therefrom, wherein the distance "Y" equals the distance "Y" that spaces the opposite hole 708 from the "H" axis). The direction (left or right from the line "$L_2$") chosen to position the hole 709 to one side or the other of the line "$L_2$" is selected by taking into account where the hole 709 can best be located without causing the link 5800 connected at this location to interfere with other components, and by taking into account the desirabilities of minimizing not only the lengths of the links 5800 but also the size of the resulting connection plate 700. What is preserved about the "optimal positioning" approach (in selecting the location of the hole 709) is that the spacing of the hole 709 from the "H" axis (the axis located between and extending substantially parallel to the lengths of the links 5800 that connect with the paired holes 708, 709) is kept substantially the same as the spacing of the hole 708 therefrom.

Referring to FIG. 25, when the connection plate 700 pivots from the non-operated orientation of FIG. 24 to the operated orientation of FIG. 25, the lines "$L_1$" and "$L_2$" preferably move substantially into registry with the vertical and horizontal axes "V" and "H." In preferred practice, the lines "$L_1$" and "$L_2$" preferably move substantially into registry with the vertical and horizontal axes "V" and "H" either when the connection plate 700 is in its non-operated position (see FIG. 25) or when the connection plate 700 is in its operated position (see FIG. 26). In this case, it is the "operated position" positioning of the connection plate 700 that brings the lines "$L_1$" and "$L_2$" into registry with the axes "V" and "H," as depicted in FIG. 26.

As the links 800, 5800 move from the non-operated locations of the holes 706, 707., 708, 709 (as shown in phantom in FIG. 26) to the operated locations of the holes 706, 707, 708, 709 (as shown in solid lines in FIG. 26), a negligible amount of transverse movement of the inner end regions of the. links 800, 5800 will take place—and, in the overall scheme of things, the fact that the non-optimal location of the hole 709 results in a slightly greater negligible amount of transverse movement than is incurred by the holes 706, 707, 708 simply does not matter in the least. What is of some import is that the more important linkage movement magnitudes (measured along the lengths of the links 800, 5800 and indicated in FIG. 26 by the dimensions "$A_1$," "$A_2$," "$B_1$" and "$B_2$") are, for all practical purposes, substantially equal despite the non-optimal location of the hole 709—therefore the latches that are connected to all four of the links 800, 5800 will operate concurrently and none will be subjected to undue stress because its associated link has moved an amount that noticeably differs in magnitude from the movement of the other links.

To help ensure that there is a minimal amount of difference in the character of the link movements, it is preferred that the angular rotation executed by the connecting plate 700 (when moving between its non-operated orientation and its operated orientation) is no greater than about thirty degrees—and, in preferred practice, the range of this movement is no greater than about twenty degrees. It also is preferred that the lines "$L_1$" and "$L_2$" align with the axes "V" and "H" at some point during the angular movement of the connection plate 700.

To minimize the normal, non-operated size of the paddle handle operating mechanism during installation of its components through a door panel opening, it is preferred that the alignment of the lines "$L_1$" and "$L_2$" with the axes "V" and "H" be selected to take place when the connection plate is pivoted to its operated orientation. By this arrangement, when the connection plate is in its normal non-operated orientation, the holes 706, 707 (and the portions of the connection plate that surround and define these holes) are located closer to the vertical axis "V" which helps to keep a majority of the connection plate 700 within the confines of the footprint of the generally rectangular housing of the paddle handle operating mechanism (to thereby minimize horizontal space occupied by the connection plate 700 for insertion through door panel opening or the like).

Thus, the design approach that is taken in locating the linkage connection holes is 1) to position them far enough from the pivot axis 703 so that the angular movement (of preferably not greater than thirty degrees, most preferably not greater than twenty degrees) that will be executed by the connection plate in response to operation of the paddle handle will effect sufficient movements "$A_1$," "$A_2$," "$B_1$" and "$B_2$" of the links 800, 5800 to operate such latches as are connected thereto; 2) to determine a range of angular movement for the right-angle-related lines "$L_1$" and "$L_2$" that will permit preferably at least as many of three of the holes to be located along the lines "$L_1$" and "$L_2$" without interfering with space that needs to be occupied by other more position critical components; 3) pick the locations of the holes that can be located along the lines "$L_1$" and "$L_2$" so that they are substantially equidistant from the pivot axis 703 so that the "X" and "Y" spacings of the links 800, 5800 will be equidistant from their respective parallel-extending axes "V" and "H;" and 4) select positions for the holes that cannot be located along the lines "$L_1$" and "$L_2$" that are as near to the optimal locations as possible and that will preserve the equal "X" and "Y" spacings of the links 800, 5800 from their respective parallel-extending axes "V" and "H".

A feature of the layout approach described above is that, if the "X" and "Y" distances are kept equal (and the other criteria set out above are met), links that operate latches that are spaced from opposite ends of the generally rectangular housing of a paddle handle operating mechanism will move substantially the same distances (measured along the lengths of the links) as links that operate latches that are spaced from opposite sides of the generally rectangular housing of the paddle handle operating mechanism. Thus, connection plates that embody the preferred practice of the present invention can be used to provide equidistant, concurrent unlatching movements for links that extend in substantially parallel but opposite directions, and for links that extend at substantially right angles to each other. This gives the paddle handle operating mechanism a great deal of versatility for use with a wide variety of latch arrays, and addresses a need that has not been fulfilled the link connection devices carried by paddle handle operating mechanisms proposed previously.

While the preceding discussion has focused primarily on the manner in which the outer link connection holes 706, 707, 708, 709 (and the like) are located, it will be understood that connection plates that embody features of the present invention also can be provided with other link connection holes, for example the inner link connection holes 716, 717, 718, 719 the locations of which are chosen by taking the same approach as is used in locating the outer link connection holes. The purpose of providing the inner connection holes is, of course, to provide link connection points that offer shorter-distance link movements, which may be what works best with one or more of the latches that are connected to links that are operated by these connection plates.

The actual configuration (as defined by the perimeters) of universal connection plates that embody the preferred practice of the present invention is not what is critical—indeed, the resulting configuration preferably is determined quite simply by eliminating unneeded plate material while ensuring that the material that remains provides sufficient strength to define regions that appropriately surround the link connection holes without interfering with other operating components of the paddle handle operating mechanism on which the universal connection plates are to be installed. In the present situation, the resulting configuration of the connection plates (as depicted in the drawings hereof) offers something of a "W-shaped" appearance. But this configuration is not what is of primary importance. What is of far greater importance are the locations chosen on the connection plates where link connection formations (typically link connection holes) are stationed, and the manner in which these locations are arrayed about the pivot axis of the connection plate.

A feature that is offered by connection plates that embody the preferred practice of the present invention is that, when they are mounted on the paddle handle operating mechanisms for which these plates are designed, the link connection formations are located in positions that take into account the "V" and "H" axes that align with the length and width of the generally rectangular housings of these mechanisms, and that provide link connections that can be utilized to provide equidistant, concurrent link movements for operating latches that may be spaced from opposite ends and/or from opposite sides of the housings (generally at locations along the "V" and "H" axes).

As will be apparent from the foregoing discussion, paddle handle operating mechanisms that utilize universal connection plates incorporating features of the present invention constitute versatile devices that can connect with different numbers of latches of various commercially available types. The fact that paddle handle operating mechanisms that incorporate different features can utilize the same universal connection plate permits latch and linkage systems to be designed that can interchangeably accept any of a variety of types of paddle handle operating mechanisms, and this enhances the degree of versatility that can be achieved with the present invention.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable handle mechanism capable of being connected to a plurality of elongate links for concurrently moving the links along their lengths to operate latches connected to the links at locations spaced from the mechanism, comprising: a generally rectangular pan-shaped housing having opposed ends and opposed sides that cooperate to define a forwardly facing recess wherein a handle is supported for movement about a handle pivot axis that extends across the recess between a selected one of the opposed sides of the housing and the opposed ends of the housing, with the handle being movable about the handle pivot axis between a normal non-operated position substantially nested within the recess and an operated position projecting from the recess; means for connection to the housing and for defining a rearwardly extending pivot axis at a substantially central location behind the recess; a connection plate having a central portion that pivots about the pivot axis and that extends in a plane that intersects the pivot axis at substantially a right angle, wherein said plane contains a first imaginary axis and a second imaginary axis that intersect at right angles at the pivot axis and extend away from the opposed ends and the opposed sides of the housing; means for drivingly interconnecting the handle and the connection plate for pivoting the connection plate about the pivot axis between a non-operated orientation and an operated orientation in response to movement of the handle from the non-operated position to the operated position; and a plurality of link connection formations defined by the connection plate wherein each of the link connection formations establishes a distinct link connection point where a separate one of the elongate links can be pivotally connected to the connection plate for being moved to operate a separate one of the latches when the connection plate pivots from the non-operated orientation to the operated orientation; wherein the link connection points defined by the plurality of link connection formations include first and second link connection points for connection with first and second ones of the elongate links that connect with first and second ones of the latches which are spaced in opposite directions from the pivot axis at locations substantially along the first imaginary axis, wherein the first and second link connection points are located on opposite sides of the pivot axis along a first imaginary line that intersects the pivot axis, and are located at positions spaced by a distance X from the first imaginary axis; wherein the link connection points defined by the plurality of link connection formations also include third and fourth link connection points for connection with third and fourth ones of the elongate links that connect with third and fourth ones of the latches which are spaced in opposite directions from the pivot axis at locations substantially along the second imaginary axis; wherein the third link connection point is located along a second imaginary line that intersects the pivot axis at right angles to the first imaginary line and at a distance Y from the second imaginary axis for connection with the third of the elongate links for operating the third of the latches; wherein the fourth connection point is located near to but spaced from the second imaginary line and on an opposite side of the second imaginary axis from the third connection point; wherein the connection plate pivots about the pivot axis through a limited range of angular movement in moving from the non-operated orientation to the operated orientation, with said range being limited to about thirty degrees; wherein the first and second imaginary lines are oriented so as to be brought into registry with the first and second imaginary axes at some instant during pivotal movement of the connection plate within said angular range as the connection plate pivots about the pivot axis from the non-operated orientation to the operated orientation; and, wherein the distance of the fourth link connection point from the second imaginary axis equals the distance Y at some instant during pivotal movement of the connection plate within said angular range as the connection plate pivots about the pivot axis from the non-operated orientation to the operated orientation.

2. The flush mountable handle mechanism of claim 1 wherein the distances X and Y are substantially equal, whereby such ones of said links as are connected to the connection plate at the first, second, third and fourth link connection points are caused by pivotal movement of the connection plate between the non-operated orientation to the operated orientation to move substantially equal distances, measured along their lengths, to substantially concurrently operate such ones of said latches as are connected thereto in response to movement of the handle from the non-operated position to the operated position.

3. The flush-mountable handle mechanism of claim 1 additionally including lock means for connection to the housing and for selectively preventing and permitting pivotal movement of the connection plate from the non-operated orientation to the operated orientation.

4. The flush-mountable handle mechanism of claim 1 additionally including lock means for connection to the housing and for selectively preventing and permitting pivotal movement of the handle from the non-operated position to the operated position.

5. The flush-mountable handle mechanism of claim 1 additionally including lock means for connection to the housing and for serving, when locked, to interrupt and reestablish a driving connection between the handle and the connection plate that is provided by said means for drivingly connecting the handle and the connection plate.

6. The flush-mountable handle mechanism of claim 1 wherein the means for establishing a driving connection between the handle and the connection plate includes: an operating arm pivotally connected to the housing for movement about a second pivot axis that substantially parallels said pivot axis at a location spaced therefrom, wherein the operating arm is drivingly connected to the handle so as to be pivoted by the handle from a primary position to a secondary position in response to movement of the handle from the non-operated position to the operated position; and means for establishing a pivotal connection between the operating arm and the connection plate for pivoting the connection plate from the non-operated orientation to the operated orientation in response to pivoting of the operating arm from the primary position to the secondary position.

7. The flush-mountable handle mechanism of claim 6 wherein the operating arm includes: first and second operating arm elements that pivot independently about the second pivot axis, wherein the first operating arm element connects with the handle for movement therewith, and the second operating arm element connects with the connection plate for movement therewith; and, lockable means for selectively establishing and disabling a driving connection between the first and second operating arm elements to selectively permit and prevent movement of the handle from the non-operated position to the operated position from causing the connection plate to pivot between the non-operated orientation and the operated orientation.

8. The flush-mountable handle mechanism of claim 6 wherein the means for selectively establishing and disabling a driving connection between the first and second operating arm elements includes a pin that is movable by the lockable means within overlying slots defined by the first and second operating arm elements between a connecting position wherein the presence of the pin in the overlying slots establishes said driving connection between the first and second operating arm elements, and a disconnecting position wherein the configuration of tile overlying slots permits relative movement of the first and second operating arm elements so as to disable the driving connection therebetween.

9. The flush-mountable handle mechanism of claim 6 wherein the means for establishing a pivotal connection between the operating arm and the connection plate includes a pin carried by the operating arm that extends into an elongate hole defined by the connection plate at a location spaced from the first, second, third and fourth connection points and spaced from said pivot axis.

10. Tile flush-mountable handle mechanism of claim 9 wherein the connection plate has peripheral portions including four corner regions that each define a separate one of the first, second, tilted and fourth connection points, and a pointed region located between a selected pair of the first, second, third and fourth connection points, with the four corner regions and the pointed region cooperating to define perimeter portions of the connection plate so as to give the connection plate a generally W-shaped configuration.

11. The flush-mountable handle mechanism of claim 1 wherein the number of link connection points defined by the plurality of link connection formations totals at least eight.

12. The flush-mountable handle mechanism of claim 10 wherein at least one of the four corner regions extends in a different plane than a plane wherein at least one other of the four corner regions extends.

13. The flush-mountable handle mechanism of claim 1 wherein at least one of said latches is a rotary type latch.

14. The flush-mountable handle mechanism of claim 1 wherein at least one of said latches is a spring-projected slide bolt type of latch.

15. The flush-mountable handle mechanism of claim 1 wherein the range of angular movement through which the connection plate pivots about the pivot axis when the handle moves from the non-operated position to the operated position is less than about twenty degrees.

16. A flush-mountable handle mechanism capable of being connected to a plurality of elongate links for concurrently moving the links along their lengths to operate latches connected to the links, comprising a generally rectangular pan-shaped housing having opposed ends and opposed sides that cooperate to define a forwardly facing recess wherein a handle is supported for movement about a handle pivot axis that extends across the recess between a selected one of the opposed sides of the housing and the opposed ends of the housing, with the handle being movable about the handle pivot axis between a normal non-operating position substantially nested within the recess and an operated position projecting from the recess, means for connection to the housing and for defining a rearwardly extending pivot axis at a substantially central location behind the recess, a connection plate having a central portion that pivots about the pivot axis and that extends in a plane that intersects the pivot axis at a right angle, wherein said plane contains first and second imaginary axes that intersect at right angles at the pivot axis and extend away from the opposed ends and the opposed sides of the housing substantially at right angles thereto, an operating arm movably connected to the housing, pivotally connected to the connection plate and drivingly connected to the handle so as to pivot the connection plate about the pivot axis between a non-operated orientation and an operated orientation in response to movement of the handle from the non-operated position to the operated position, and a plurality of link connection formations arranged in pairs on opposite sides of the pivot axis for connection with at least one opposed pair of links extending in opposite directions from the pivot axis for concurrently operating latches connected to the links, with at least one of the pairs of link connection formations being located closer to the pivot axis than at least one other of the pairs of link connection formations so as to provide alternate locations where the links of said one opposed pair can connect with different ones of the link connection formations to change the distances the links move, measured along their lengths, in response to identical angular movements of the connection plate about the pivot axis.

17. The flush-mountable handle mechanism of claim 16 wherein the link connection formations arranged in pairs include at least four pairs of link connection formations with two of the pairs being suited for connection to opposed links that extend away from opposite ends of the generally rectangular housing for moving substantially equidistantly to concurrently operate latches connected thereto, and with another two of the pairs being suited for connection to opposed links that extend away from opposite sides of the generally rectangular housing for moving substantially equidistantly to concurrently operate latches connected thereto.

18. The flush-mountable handle mechanism of claim 16 additionally including lock means for connection to the housing and for selectively preventing and permitting pivotal movement of the connection plate from the non-operated orientation to the operated orientation.

19. The flush-mountable handle mechanism of claim 16 additionally including lock means for connection to the housing and for selectively preventing and permitting pivotal movement of the handle from the non-operated position to the operated position.

20. The flush-mountable handle mechanism of claim 16 additionally including lock means for connection to the housing and for serving, when locked, to interrupt and reestablish a driving connection between the handle and the connection plate that is provided by said means for drivingly connecting the handle and the connection plate.

21. The flush-mountable handle mechanism of claim 16 wherein the operating arm includes a pair of overlying links that pivot independently about the second pivot axis, and the flush-mountable handle mechanism additionally includes lockable means for selectively establishing and disabling a driving connection between the pair of overlying links to selectively permit and prevent movement of the handle from the non-operated position to the operated position from causing the connection plate to pivot between the non-operated orientation and the operated orientation.

22. The flush-mountable handle mechanism of claim 21 wherein the lockable means for selectively establishing and disabling a driving connection between the pair of overlying links includes a pin that is movable within overlying slots defined by the pair of overlying links between a connecting position wherein the presence of the pin in the overlying slots establishes said driving connection between the pair of overlying links, and a disconnecting position wherein the configuration of the overlying slots permits relative movement of the overlying links so as to disable the driving connection therebetween.

23. The flush-mountable handle mechanism of claim 16 wherein the pivotal connection between the operating arm and the connection plate is provided by a pin carried by the operating arm that extends into an elongate hole defined by the connection plate at a location spaced from the first, second, third and fourth connection points and spaced from said pivot axis.

24. The flush-mountable handle mechanism of claim 23 wherein the connection plate has peripheral portions including four corner regions that each define a separate one of the connection points, and a pointed region located in between two of corner regions, with the four corner regions and the pointed region cooperating to provide the connection plate with a generally W-shaped configuration.

25. The flush-mountable handle mechanism of claim 24 wherein at least one of the four corner regions extends in a different plane than a plane wherein at least one other of the four corner regions extends.

26. The flush-mountable handle mechanism of claim 16 wherein the number of link connection points defined by the plurality of link connection formations totals at least eight.

27. The flush-mountable handle mechanism of claim 16 wherein at least one of said latches is a rotary type latch.

28. The flush-mountable handle mechanism of claim 16 wherein at least one of said latches is a spring-projected slide bolt type of latch.

29. A flush-mountable handle mechanism capable of being connected to a plurality of elongate links for concurrently moving the links along their lengths to operate latches connected to the links at locations spaced from the mechanism, comprising a generally rectangular pan-shaped housing having opposed ends and opposed sides that cooperate to define a forwardly facing recess wherein a handle is supported for movement about a handle pivot axis that extends across the recess between a selected one of the opposed sides of the housing and the opposed ends of the housing, with the handle being movable about the handle pivot axis between a normal non-operated position substantially nested within the recess and an operated position projecting from the recess; a connection plate connected to the housing for pivotal movement about a pivot axis that extends rearwardly with respect to the housing at a location situated behind the recess; a plurality of outer link connection points defined by corner regions of the connection plate; a plurality of inner link connection points defined by portions of the connection plate situated between the pivot axis and the corner regions; means for drivingly interconnecting the handle and the connection plate for pivoting the connection plate about the pivot axis between a non-operated orientation and an operated orientation in response to movement of the handle from the non-operated position to the operated position; and, wherein a range of angular movement executed by the connection plate in pivoting about the pivot axis from the non-operated orientation to the operated orientation is less than about thirty degrees.

30. The flush-mountable handle mechanism of claim 29 wherein the range of angular movement through which the connection plate pivots about the pivot axis when the handle moves from the non-operated position to the operated position is less than about twenty degrees.

31. The flush-mountable handle mechanism of claim 29 additionally including lock means for connection to the housing and for selectively preventing and permitting pivotal movement of the connection plate from the non-operated orientation to the operated orientation.

32. The flush-mountable handle mechanism of claim 29 additionally including lock means for connection to the housing and for selectively preventing and permitting pivotal movement of the handle from the non-operated position to the operated position.

33. The flush-mountable handle mechanism of claim 29 additionally including lock means for connection to the housing and for serving, when locked, to interrupt and reestablish a driving connection between the handle and the connection plate that is provided by said means for drivingly connecting the handle and the connection plate.

34. The flush-mountable handle mechanism of claim 29 wherein the means for establishing a driving connection between the handle and the connection plate includes: an operating arm pivotally connected to the housing for movement about a second pivot axis that substantially parallels said pivot axis at a location spaced therefrom, wherein the operating arm is drivingly connected to the handle so as to be pivoted by the handle from a primary position to a secondary position in response to movement of the handle from the non-operated position to the operated position; and means for establishing a pivotal connection between the operating arm and the connection plate for pivoting the connection plate from the non-operated orientation to the operated orientation in response to pivoting of the operating arm from the primary position to the secondary position.

35. The flush-mountable handle mechanism of claim 34 wherein the operating arm includes: first and second operating arm elements that pivot independently about the second pivot axis, wherein the first operating arm element connects with the handle for movement therewith, and the second operating arm element connects with the connection plate for movement therewith; and, lockable means for selectively establishing and disabling a driving connection between the first and second operating arm elements to selectively permit and prevent movement of the handle from the non-operated position to the operated position from causing the connection plate to pivot between the non-operated orientation and the operated orientation.

36. The flush-mountable handle mechanism of claim 34 wherein the means for selectively establishing and disabling a driving connection between the first and second operating arm elements includes a pin that is movable by the lockable means within overlying slots defined by the first and second operating arm elements between a connecting position wherein the presence of the pin in the overlying slots establishes said driving connection between the first and second operating arm elements, and a disconnecting position wherein the configuration of the overlying slots permits relative movement of the first and second operating arm elements so as to disable the driving connection therebetween.

37. The flush-mountable handle mechanism of claim 34 wherein the means for establishing a pivotal connection between the operating arm and the connection plate includes a pin carried by the operating arm that extends into an elongate hole defined by the connection plate at a location spaced from the connection points and spaced from said pivot axis.

38. The flush-mountable handle mechanism of claim 37 wherein the connection plate has peripheral portions including four corner regions that each define a separate one of the connection points, and a pointed region located between a selected pair of the connection points, with the four corner regions and the pointed region cooperating to define perimeter portions of the connection plate so as to give the connection plate a generally W-shaped configuration.

39. The flush-mountable handle mechanism of claim 38 wherein at least one of the four corner regions extends in a different plane than a plane wherein at least one other of the four corner regions extends.

40. The flush-mountable handle mechanism of claim 29 wherein the range of angular movement through which the connection plate pivots about the pivot axis when the handle moves from the non-operated position to the operated position is less than about twenty degrees.

41. A flush-mountable paddle handle operating mechanism including a generally rectangular pan-shaped housing having opposed ends and opposed sides that cooperate to define a forwardly facing recess wherein a handle is supported for movement about a handle pivot axis that extends across the recess between a selected one of the opposed sides of the housing and the opposed ends of the housing, with the handle being movable about the handle pivot axis between a normal non-operated position substantially nested within the recess and an extended position projecting from the recess, and a connection plate drivingly connected to the handle and being pivotal about a pivot axis extending rearwardly with respect to the housing from a non-operated orientation to an operated orientation in response to movement of the handle from a non-operated position to an operated position, wherein the connecting plate defines first, second, third and fourth connection formations adapted to be connected, respectively, to first, second, third and fourth elongate links for operating, respectively, first, second, third and fourth latches, with the first and second connection formations being located on opposite sides of the pivot axis, at an equal distance from the pivot axis, and along an imaginary first line that intersects the pivot axis, with the third connection formation being located along an imaginary second line that intersects the first line at right angles at the pivot axis, and at said equal distance from the pivot axis, and with the fourth connection formation being located on an opposite side of the pivot axis from the third connection formation and offset from the second line along an imaginary third line that intersects the second line at said equal distance from the pivot axis and in a direction that parallels a direction in which the third and fourth links will extend when connected to the third and fourth connection formations and to the third and fourth latches.

42. The flush-mountable handle mechanism of claim 41 wherein the range of angular movement through which the connection plate pivots about tile pivot axis when the handle moves from the non-operated position to the operated position is less than about thirty degrees.

43. The flush-mountable handle mechanism of claim 41 additionally including lock means for connection to the housing and for selectively preventing and permitting pivotal movement of the connection plate from the non-operated orientation to the operated orientation.

44. The flush-mountable handle mechanism of claim 41 additionally including lock means for connection to the housing and for selectively preventing and permitting pivotal movement of the handle form the non-operated position to the operated position.

45. The flush-mountable handle mechanism of claim 41 additionally including lock means for connection to the housing and for serving, when locked, to interrupt and reestablish a driving connection between the handle and the connection plate.

46. The flush-mountable handle mechanism of claim 41 additionally including means for establishing a driving connection between the handle and the connection plate including: an operating arm pivotally connected to the housing for movement about a second pivot axis that substantially parallels said pivot axis at a location spaced therefrom, wherein the operating arm is drivingly connected to the handle so as to be pivoted by the handle from a primary position to secondary position in response to movement of the handle from the non-operated position to the operated position; and means for establishing a pivotal connection between the operating arm and the connection plate for pivoting the connection plate from the non-operated orientation to the operated orientation in response to pivoting of the operating arm from the primary position to the secondary position.

47. The flush-mountable handle mechanism of claim 46 wherein the operating arm includes: first and second operating arm elements that pivot independently about the second pivot axis, wherein the first operating arm element connects with the handle for movement therewith, and the second operating arm element connects with the connection plate for movement therewith; and, lockable means for selectively establishing and disabling a driving connection between the first and second operating are elements to selectively permit and prevent movement of the handle from the non-operated position to the operated position from causing the connection plate to pivot between the non-operated orientation and the operated orientation.

48. The flush-mountable handle mechanism of claim 46 wherein the means for selectively establishing and disabling a driving connection between the first and second operating arm elements includes a pin that is movable by the lockable means within overlying slots defined by the first and second operating arm elements between a connecting position-wherein the presence of the pin in the overlying slots establishes said driving connection between the first and second operating arm elements, and a disconnecting position wherein the configuration of the overlying slots permits relative movement of the first and second operating arm elements so as to disable the driving connection therebetween.

49. The flush-mountable handle mechanism of claim 46 wherein the means for establishing a pivotal connection between the operating arm and the connection plate includes a pin carried by the operating arm that extends into an elongate hole defined by the connection plate at a location spaced from the first, second, third and fourth connection points and spaced from said pivot axis.

50. A flush-mountable paddle handle operating mechanism including a generally rectangular pan-shaped housing having opposed ends and opposed sides that cooperate to define a forwardly facing recess wherein a handle is supported for movement about a handle pivot axis that extends across the recess between a selected one of the opposed sides of the housing and the opposed ends of the housing, with the handle being movable about the handle pivot axis between a normal non-operated position substantially nested within the recess and an operated position projecting from the recess, and a connection plate drivingly connected to the handle and being pivotal about a pivot axis extending rearwardly with respect to the housing from a non-operated orientation to an operated orientation in response to movement of the handle from a non-operated position to an operated position; wherein the connecting plate defines first, second, third and fourth connection formations adapted to be connected, respectively, to first, second, third and fourth elongate links for operating, respectively, first, second, third and fourth latches; wherein the first and second latches are located on opposite sides of the pivot axis along an imaginary first axis that intersects the pivot axis; wherein the third and fourth latches are located on opposite sides of the pivot axis along an imaginary second axis that intersects the pivot axis; wherein the first and second connection formations are located on opposite sides of the pivot axis for oppositely moving the first and second links when the first and second links extend along opposite sides of and substantially parallel to the imaginary first axis; wherein the third and fourth connection formations are located on opposite sides of the pivot axis for oppositely moving the third and fourth links when the third and fourth links extend along opposite sides of and substantially parallel to the imaginary second axis; wherein the first and second connection formations are located at equal distances from the imaginary first axis; wherein the third and fourth connection formations are located at equal distances from the imaginary second axis; and, wherein at least one of the first, second, third and fourth connection formations fails to reside along a set of right angle lines that intersect at the pivot axis and with all others of the first, second, third and fourth connection formations.

* * * * *

UNITED STATES PATENT AND TRADEMARK OFFICE

CERTIFICATE OF CORRECTION

PATENT NO. : 6,490,895 B1
DATED : December 10, 2002
INVENTOR(S) : Weinerman et al.

It is certified that error appears in the above-identified patent and that said Letters Patent is hereby corrected as shown below:

Column 27,
Line 43, delete “tilted” and substitute -- third --

Column 31,
Line 60, delete “tile” and substitute -- the --

Column 32,
Line 35, delete “are” and substitute -- arm --
Line 45, delete “position-” and substitute -- position --

Signed and Sealed this

Fourteenth Day of October, 2003

JAMES E. ROGAN
*Director of the United States Patent and Trademark Office*